US010986873B2

(12) United States Patent
Qiu

(10) Patent No.: US 10,986,873 B2
(45) Date of Patent: Apr. 27, 2021

(54) ELECTRONIC CIGARETTE

(71) Applicant: Changzhou Patent Electronic Technology Co., LTD, Jiangsu (CN)

(72) Inventor: Weihua Qiu, Jiangsu (CN)

(73) Assignee: Changzhou Patent Electronic Technology Co., LTD, Jiangsu (CN)

( * ) Notice: Subject to any disclaimer, the term of this patent is extended or adjusted under 35 U.S.C. 154(b) by 204 days.

(21) Appl. No.: 16/234,176

(22) Filed: Dec. 27, 2018

(65) Prior Publication Data

US 2019/0124996 A1 May 2, 2019

Related U.S. Application Data

(63) Continuation-in-part of application No. 15/713,282, filed on Sep. 22, 2017, now abandoned, which is a continuation-in-part of application No. PCT/CN2017/097396, filed on Aug. 15, 2017.

(30) Foreign Application Priority Data

Oct. 12, 2016 (CN) ..... 201621116845.8
Dec. 5, 2018 (CN) ..... 201811484008.4

(51) Int. Cl.
*A24F 47/00* (2020.01)
*A24F 7/02* (2006.01)

(52) U.S. Cl.
CPC ..... *A24F 47/008* (2013.01); *A24F 7/02* (2013.01)

(58) Field of Classification Search
None
See application file for complete search history.

(56) References Cited

U.S. PATENT DOCUMENTS

| | | | | |
|---|---|---|---|---|
| 2,065,223 | A | 12/1936 | Rudolph | |
| 6,095,153 | A | 8/2000 | Kessler et al. | |
| 2011/0226236 | A1 | 9/2011 | Buchberger | |
| 2013/0192623 | A1 * | 8/2013 | Tucker | A24F 40/70 131/329 |
| 2014/0150785 | A1 | 6/2014 | Malik et al. | |

(Continued)

FOREIGN PATENT DOCUMENTS

| | | | |
|---|---|---|---|
| CN | 2719043 | Y | 8/2005 |
| CN | 201199922 | Y | 3/2009 |

(Continued)

*Primary Examiner* — Eric Yaary
(74) *Attorney, Agent, or Firm* — Novick, Kim & Lee, PLLC; Allen Xue

(57) ABSTRACT

An electronic cigarette includes a first surface, a second surface, a third surface, a fourth surface, a fifth surface, and a sixth surface. The first and the second surfaces are parallel to each other, the third and the fourth surfaces are parallel to each other, the fifth and the sixth surfaces are parallel to each other. The two opposite sides of the third surface are respectively connected to the first surface and the sixth surface. The side of the sixth surface away from the third surface is connected to the second surface. The two opposite sides of the fifth surface are respectively connected to the first surface and the fourth surface. The side of the fourth surface away from the fifth surface is connected to the second surface. The angle between the first surface and the third surface and the angle between the first surface and the fifth surface are both obtuse angles.

16 Claims, 24 Drawing Sheets

(56) References Cited

U.S. PATENT DOCUMENTS

| | | | | |
|---|---|---|---|---|
| 2014/0363145 | A1* | 12/2014 | Plojoux | A61M 11/042 392/386 |
| 2015/0013700 | A1 | 1/2015 | Liu | |
| 2015/0027462 | A1* | 1/2015 | Liu | A24F 47/008 131/329 |
| 2015/0027467 | A1 | 1/2015 | Liu | |
| 2015/0136157 | A1 | 5/2015 | Liu | |
| 2015/0181940 | A1 | 7/2015 | Liu | |
| 2015/0335074 | A1 | 11/2015 | Leung | |
| 2016/0331030 | A1 | 11/2016 | Ampolini et al. | |
| 2018/0007954 | A1 | 1/2018 | Mishra et al. | |

FOREIGN PATENT DOCUMENTS

| | | | |
|---|---|---|---|
| CN | 201370099 | Y | 12/2009 |
| CN | 201839801 | U | 5/2011 |
| CN | 202154026 | U | 7/2011 |
| CN | 203087529 | U | 7/2013 |
| CN | 203341011 | U | 12/2013 |
| CN | 203608850 | U | 5/2014 |
| CN | 203643774 | U | 6/2014 |
| CN | 203692552 | U | 7/2014 |
| CN | 2014130176 | A1 | 8/2014 |
| CN | 206284385 | U | 6/2017 |
| WO | 2014190502 | A1 | 12/2014 |

* cited by examiner

ELECTRONIC CIGARETTE

CROSS REFERENCE TO RELATED APPLICATIONS

This application is a continuation-in-part application of U.S. application Ser. No. 15/713,282, filed on Sep. 22, 2017, which is a continuation-part application of International Patent Application No. PCT/CN2017/097396, filed on Aug. 15, 2017, which claims priority to Chinese Patent Application No. 201621116845.8, filed on Oct. 12, 2016, the entire contents of all of these applications are hereby incorporated by reference herein.

In addition, this application also claims priority to Chinese Patent Application No. 201811484008.4, filed on Dec. 5, 2018.

FIELD

The present disclosure relates to the technical field of electronic cigarettes, and more particularly to an electronic cigarette.

BACKGROUND

Presently, cigarette mouthpieces for electronic cigarettes are usually made of hard plastic or soft materials. A cigarette mouthpiece made of soft materials can provide a better tactility and have a wider application. However, the connection of the cigarette mouthpiece made of soft material is not reliable. In addition, the service life of the cigarette mouthpiece made of soft material is shorter than that of the cigarette mouthpiece made of hard plastic. The cigarette mouthpiece made of soft material may discolor and be contaminated easily.

In addition, the existing electronic cigarette is not convenient for the user to hold or pinch, unable to provide a good grip experience when the user inhale.

SUMMARY

In order to solve the above at least one technical problem, the present disclosure provides an electronic cigarette that is easy to hold.

An electronic cigarette of the present disclosure is as follows:

An electronic cigarette includes a first surface, a second surface, a third surface, a fourth surface, a fifth surface, and a sixth surface, the first surface and the second surface are parallel to each other, the third surface and the fourth surface are parallel to each other, the fifth surface and the sixth surface are parallel to each other, the two opposite sides of the third surface are respectively connected to the first surface and the sixth surface, one side of the sixth surface away from the third surface is connected to the second surface, the two opposite sides of the fifth surface are respectively connected to the first surface and the fourth surface; the side of the fourth surface away from the fifth surface is connected to the second surface; the angle between the first surface and the third surface, the angle between the first surface and the fifth surface are both obtuse angles; the angle between the second surface and the fourth surface, and the angle between the second surface and the sixth surface are also obtuse angles; the angle between the third surface and the sixth surface, and the angle between the fourth surface and the fifth surface are both acute angles.

In one embodiment, the electronic cigarette is further provided with a window section located on each of the first surface and the second surface, or the window section is located on one of the first surface and the second surface, or the electronic cigarette is further provided with a window section located on one of the first surface and the second surface or one of the first surface and the second surface; the window section has a hexagon structure, the electronic cigarette further includes a reservoir chamber configured for storing cigarette liquid, a window portion and a storage portion through which the liquid received in the chamber is visible, the window portion is exposed through the window section.

In one embodiment, the window portions includes a first side, a second side, a third side, a fourth side, a first vertical side and a second vertical side, the first vertical side and the second vertical side are parallel to each other and are disposed along the axial direction of the electronic cigarette, the first side and the second side are located at the upper ends of the first vertical side and the second vertical side, the third side and the fourth side are located at a lower end of the first vertical side and the second vertical side, the two ends of the first side are respectively connected to the first vertical side and the second side, one end of the second side away from the first side is connected to the second vertical side, the opposite ends of the third side are respectively connected to the first vertical side and the fourth side, one end of the fourth side away from the third side is connected with the second vertical side, the first side and the fourth side are parallel to each other, the second side and the third side are parallel to each other; the side lengths of the first side, the second side, the third side and the fourth side are equal, the side lengths of the first vertical side and the second vertical side are equal; the side length of the first vertical side or the second vertical side is longer than any side lengths of the first side, the second side, the third side and the fourth side.

In one embodiment, the electronic cigarette defines a smoke outlet located at its top end, there are two recesses disposed adjacent to the smoke outlet, the recesses are respectively disposed on the first surface and the second surface, the electronic cigarette further includes two soft substrates, the soft substrate are located in the two recesses, respectively.

In one embodiment, a curved connection is connected between two adjacent surfaces of the electronic cigarette.

In one embodiment, the first surface, the second surface, the third surface, the fourth surface, the fifth surface, and the sixth surface are flat surfaces, the area of the first surface and the area of the second surface are equal, the area of the first surface or the second surface is larger than any one of the third surface, the fourth surface, the fifth surface, and the sixth surface.

In one embodiment, the distance between the first surface and the second surface is shorter than the distance between the third surface and the fourth surface; the distance between the first surface and the second surface is shorter than the distance between the fifth surface and the sixth the surfaces.

In one embodiment, the electronic cigarette includes a cartomizer and a power supply device electrically connected to the cartomizer, the first surface, the second surface, the third surface, the fourth surface, the fifth surface, and the sixth surface respectively include a first segment and a second segment; the first surface, the second surface, the third surface, the fourth surface, the fifth surface, and the sixth surface are respectively formed by corresponding side surfaces of the mouthpiece cover; the first surface, the second surface, the third surface, the fourth surface, the fifth surface, and the sixth surface of the second segment are respectively formed by corresponding side surfaces of the outer casing of the power supply device.

In one embodiment, the window portion includes a first window notch and a second window notch, the first window notch is defined on the first segment of the first surface or the first segment of the second surface, the second window notch corresponding the first window notch is defined in the second segment of the first surface or the second segment of the second surface, the first window notch and the second window notch are defined in the same surface.

In one embodiment, the cartomizer includes a housing and a mouthpiece cover sleeved on the housing, the housing includes a reservoir portion and two window portions located on the outside surface of the reservoir portion, the first window notch is defined on the mouthpiece cover, a portion of the window portion is exposed through the first window notch, a portion of the storage portion is shield by the mouthpiece cover, the power supply device comprise a outer casing, the second window notch is defined on the outer casing, when the cartomizer is connected to the power supply device, the other portion of the window portion is exposed through the second window notch, the other portion of the storage portion is shield by the outer casing.

In one embodiment, the window portion protrudes from an outer surface of the storage portion, and the cooperation of the window portion with the second window notch guides the installation of the cartomizer and the power supply device.

In one embodiment, there are two first window notches, the first window notches respectively extend through the bottom end of the first segment of the first surface and the bottom end of the first segment of the second surface; there are two second window notches, the second window notches respectively extend through the top end of the first segment of the first surface and the top end of the first segment of the second surface.

In one embodiment, the first window notch includes the first side, the second side, the fifth side, the seventh side; the second window notch includes the third side, the fourth side, the sixth side, and the eighth side, when the cartomizer is connected to the power supply device, the fifth side and the sixth side cooperate to form the first vertical side, the seventh side and the eighth side cooperate to form the second vertical side.

In one embodiment, there are two window parts having a hexagon structure, the two hexagonal window portions are symmetrically disposed about the center line of the first surface and the center line of the second surface, respectively.

In one embodiment, the side length of the fifth side is equal to the side length of the seventh side, the side length of the sixth side is equal to the side length of the eighth side, the side length of the fifth side or the seventh side is longer than the side length the sixth side or the eighth side.

In one embodiment, the cartomizer includes a housing and a mouthpiece cover sleeved on the housing, the recesses are defined on the mouthpiece cover.

In one embodiment, the portions of the third surface, the fourth surface, the fifth surface, and the sixth surface that are adjacent to the smoke outlet are contracted toward the central axis of the electronic cigarette respectively.

In one embodiment, the outer casing defines a cartomizer receiving chamber therein, the cartomizer is detachably inserted into the cartridge receiving cavity.

In one embodiment, the sidewall of the cartomizer receiving chamber is provided with an engaging projection, the clamping groove is disposed on the sidewall of the housing corresponding to the engaging projection, the outer casing is provided with an indication mark corresponding to the engaging projection.

In one embodiment, the outer casing is made of metal, the mouthpiece cover is made of plastic.

When the user holds the electronic cigarette, the first knuckle and the second knuckle are respectively attached to the fifth surface and the fourth surface, the third knuckle is attached to the second surface. Alternatively, the first knuckle and the second knuckle are respectively attached to the sixth surface and the third surface, the third knuckle is attached to the first surface, which is ergonomic and makes the user's grip feel better.

BRIEF DESCRIPTION OF THE DRAWINGS

The drawings are provided for further understanding of the disclosure and constitute a part of the specification, and are used, together with the following detailed description, to explain the disclosure, and should not be construed as a limitation for the disclosure. In the drawings.

Figure 1:
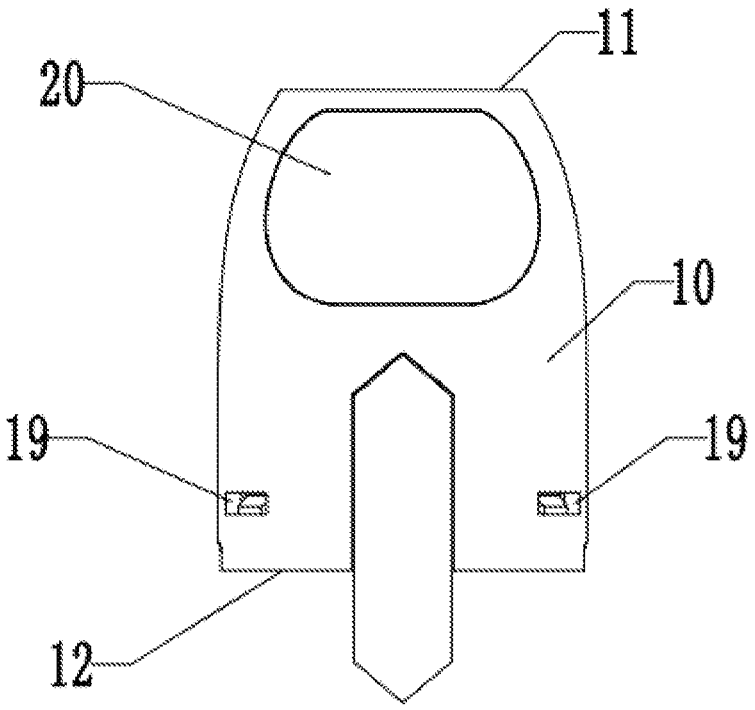
FIG. 1 is a front view of a cigarette mouthpiece according to an embodiment of the present disclosure.
Figure 2:
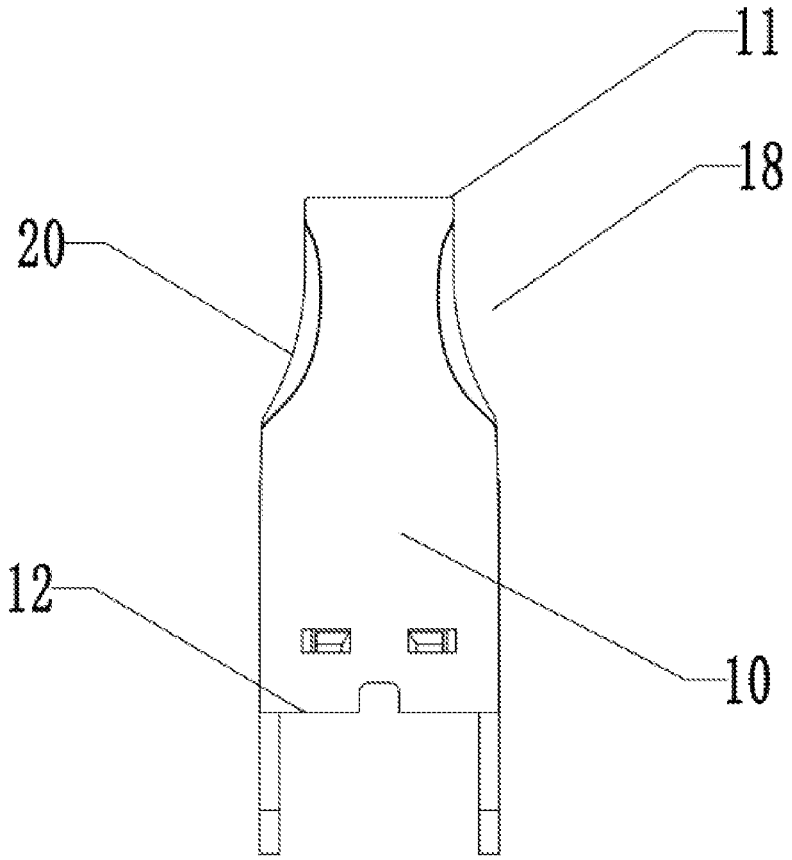
FIG. 2 is a side view of the cigarette mouthpiece shown in FIG. 1.
Figure 3:
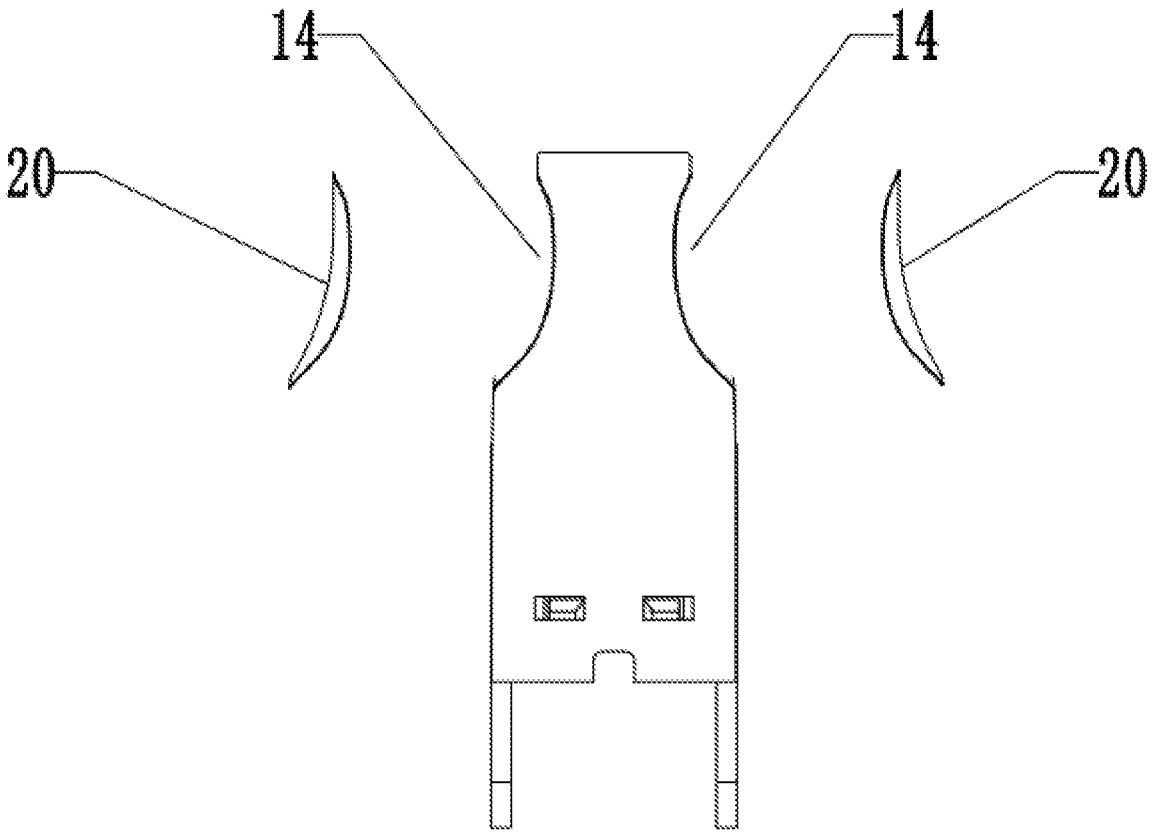
FIG. 3 is an exploded schematic view of the cigarette mouthpiece shown in FIG. 1.
Figure 4:
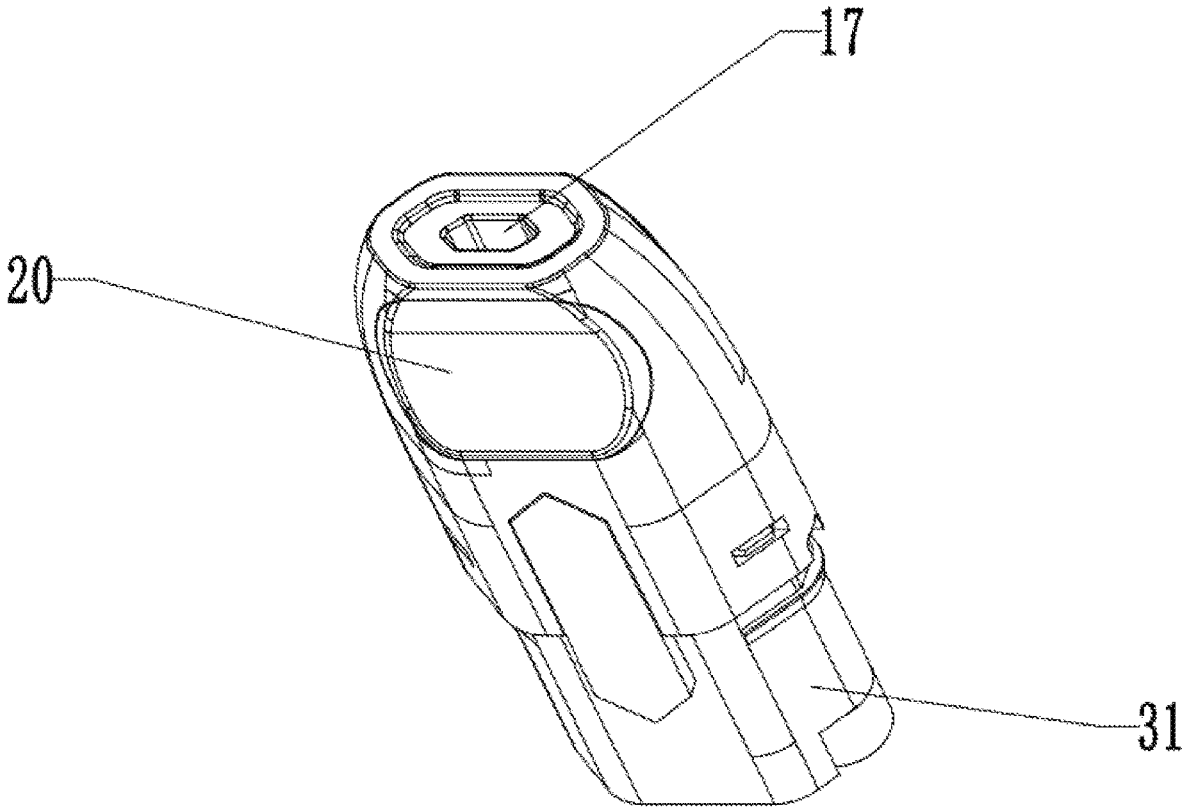
FIG. 4 is a perspective schematic view of a cartomizer comprising the cigarette mouthpiece shown in FIG. 1.

The following table list various components and reference numerals thereof.

| | | | |
|---|---|---|---|
| Hard Substrate 10 | Top End 11 | Bottom End 12 | Retaining Protrusion 13 |
| Groove 14 | Upper Section 15 | Lower Section 16 | Smoke Outlet 17 |
| Concave Portion 18 | Latching Structure 19 | Soft Substrate 20 | fixed end 201 |
| Movable end 202 | Convex portion 203 | Retaining Hole 21 | Mouthpiece cover 22 |
| Communication pipe 221 | Air outlet 23 | Airtight member 24 | Sealing portion 241 |
| Communication groove 2411 | Insertion portion 242 | First sealing member 25 | Notch 251 |
| Vent tube 26 | Limiting boss 261 | Housing 27 | Extension port 271 |
| Air inlet 28 | Intake passage 29 | Outlet passage 30 | Main body 31 |
| Clamping groove 311 | Induction air passage 32 | Window portion 33 | Storage portion 34 |
| Second sealing member 35 | First induction air passage through hole 36 | Second electrode 37 | Negative electrode contact 38 |
| Heating element 39 | Heating section 391 | First pin 392 | Second pin 393 |
| Prefabricated cavity 40 | Power supply device 41 | Second window notch 411 | Cartomizer receiving chamber 412 |
| Engaging projection 42 | Indication mark 421 | Second induction air Passage through hole 43 | Extension seat 44 |
| Electrode contact 45 | Pre-groove 46 | Sensor 47 | Liquid absorbing member 48 |
| Reservoir chamber 49 | Liquid injection hole 491 | Liquid injection plug 492 | Atomizing chamber 50 |
| Sensor mounting base 51 | Insulating member 52 | First surface 61 | Second surface 62 |
| Third surface 63 | Fourth surface 64 | Fifth surface 65 | Sixth surface 66 |
| First window notch 67 | First side 73 | Second side 74 | Third side 77 |
| Fourth side 78 | Fifth side 71 | Sixth side 75 | Seventh side 72 |
| Eighth side 76 | Atomizing head 80 | Atomizing sleeve 81 | Liquid guiding hole 82 |
| Electronic cigarette 100 | | | |

DETAILED DESCRIPTION

Specific embodiments of the present disclosure will be described in detail below with reference to the drawings. It should be understood that the specific embodiments described herein are for the purpose of illustration and explanation of the present disclosure, and are not intended to limit the disclosure.

As shown in FIGS. 1-4, a cigarette mouthpiece for an electronic cigarette is provided in the present disclosure. The cigarette mouthpiece comprises a hard substrate 10. A soft substrate 20 is mounted on the outside of the hard substrate 10. In one embodiment, the hard substrate 10 is made of one of a group of hard plastic, stainless steel and glass. It can be appreciated that the hard substrate 10 can be made of other hard materials to support the soft substrate 20. A through hole (not shown) is defined inside the hard substrate 10 and extends through two opposite ends of the hard substrate 10. The through hole is mainly configured as a smoke passage when the user inhales. It can be appreciated that the electronic cigarette is an automatic electronic cigarette and an independent inductive passage can be defined inside the through hole.

In one embodiment, the hard substrate 10 having an approximately flat shape comprises a top end 11 and a bottom end 12 opposite to the top end 11. The bottom end 12 is relatively wider than the top end 11 and is configured to connect to a main body 31 of a cartomizer. The bottom end 12 can have any shape, such as a rectangular parallelepiped shape or a cylindrical shape. In one embodiment, the bottom end 12 is detachably connected to the main body 31 by clamping or screwing. It can be appreciated that the fixed connection, such as clasping connection, is also applicable. In this embodiment, the cigarette mouthpiece and the main body 31 are fixed together via a latching structure 19. In this embodiment, the top end 11 has a rectangular parallelepiped shape. It can be appreciated that, the top end 11 can have any shape, such as a cylindrical shape or an ellipse cylinder shape.

A concave portion 18 is defined on the hard substrate 10 and located between the top end 11 and the bottom end 12. In one embodiment, there are two concave portions 18. The two concave portions 18 are located on the front side and the rear side of the hard substrate 10, respectively. In one embodiment, each concave portion 18 defines a groove 14. When the soft substrate 20 is mounted in the groove 14, the outer surface of the entire concave portion 18 becomes a smooth curved surface accordingly.

A through hole is defined inside the hard substrate 10 and extends through the top end 11 and the bottom end 12. Smoke outlet 17 is the opening of the through hole located at the top end 11.

When the user inhales, the smoke can be sucked off from the smoke outlet 17. The lips of the user contact with the soft substrate 20, and the user can obtain comfortable tactility.

The soft substrate 20 can be made of elastic materials. The appropriate elastic material can be selected from one of a group of silicone resin, latex, thermoplastic elastomer (TPE), ethylene-vinyl acetate copolymer (EVA) and soft silicone rubber. It can be appreciated that other soft and environmentally friendly materials are also applicable.

Each of the opposite sides of the hard substrate 10 defines a groove 14, and the two soft substrates 20 are mounted in the corresponding grooves 14 respectively.

In one embodiment, the soft substrate 20 is a sheet. Specifically, soft substrate 20 has a shape selected from one of a group of circular, square and ellipse. Furthermore, the two ends of the soft substrate 20 are relatively thinner than the middle portion of the soft substrate 20. The shape of the groove 14 is configured to fit such soft substrate 20.

In one embodiment, the soft substrate 20 is melted at a high temperature and then adhered to the groove 14.

Figure 5:
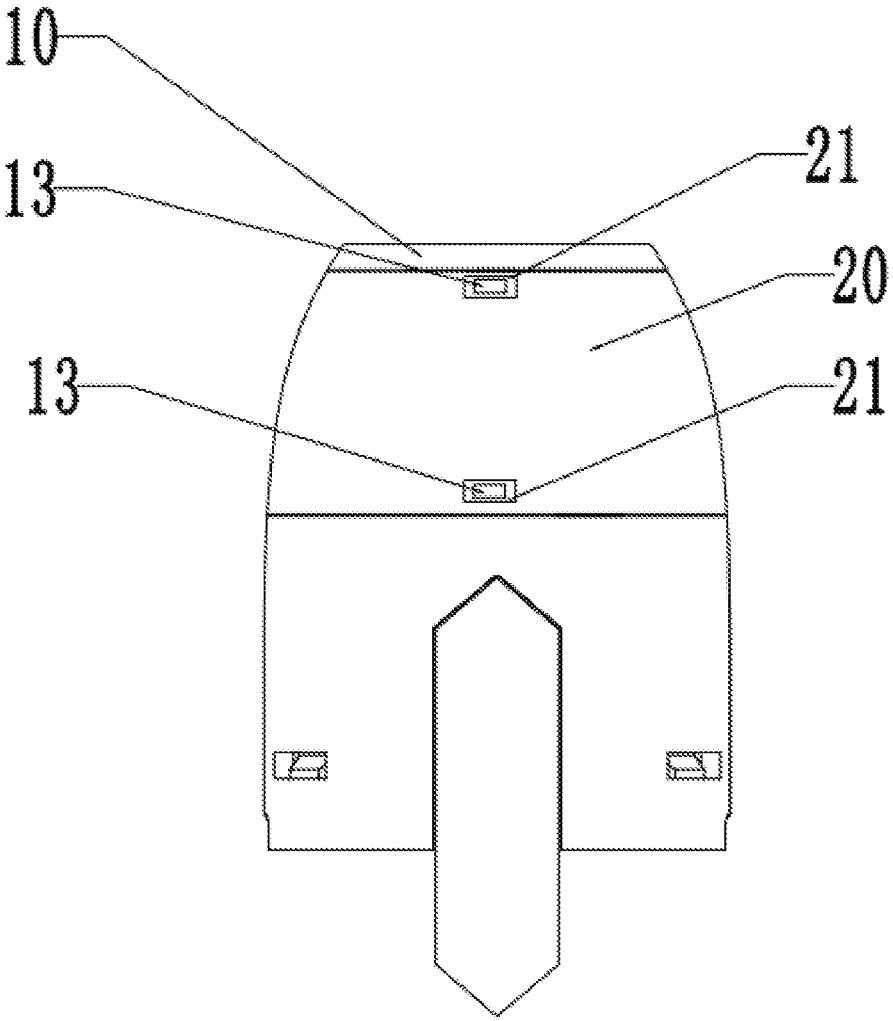
FIG. 5 is a front view of a cigarette mouthpiece according to another embodiment of the present disclosure.
Figure 6:
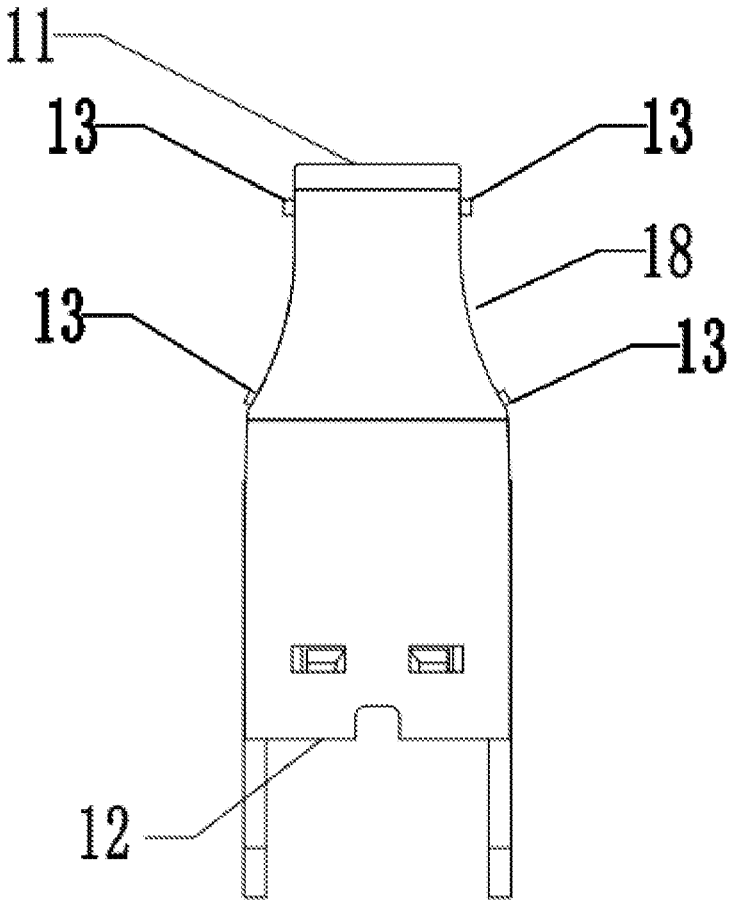
FIG. 6 is a side view of the cigarette mouthpiece shown in FIG. 5.

As shown in FIG. 5 and FIG. 6, in one embodiment, the soft substrate 20 is disposed around the hard substrate 10. That is, the soft substrate 20 has a sleeve shape and is sleeved on the outside of the hard substrate 10. In one embodiment, a retaining protrusion 13 is defined on the concave portion 18, and a retaining hole 21 corresponding to the retaining protrusion 13 is defined on the soft substrate 20. The retaining protrusion 13 inserts into the retaining hole 21 to prevent the soft substrate 20 from slipping.

It can be appreciated that two retaining protrusions 13 configured to retain the soft substrate 20 can be defined on the outside of the hard substrate 10 along the circumferential direction of the hard substrate 10. One retaining protrusion 13 is adjacent to the top end 11, and the other retaining protrusion 13 is adjacent to the bottom end 12. The soft substrate 20 is located between the two retaining protrusions 13.

Figure 7:
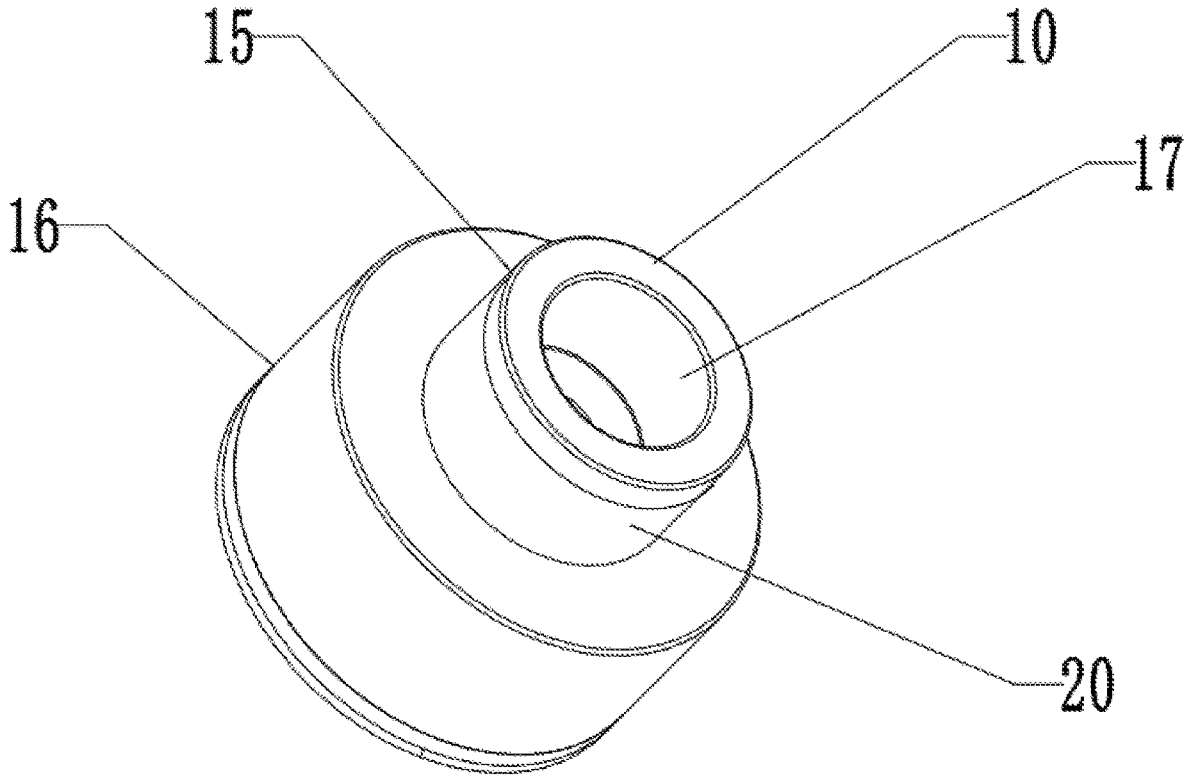
FIG. 7 is a perspective schematic view of a cigarette mouthpiece according to a still another embodiment of the present disclosure.
Figure 8:
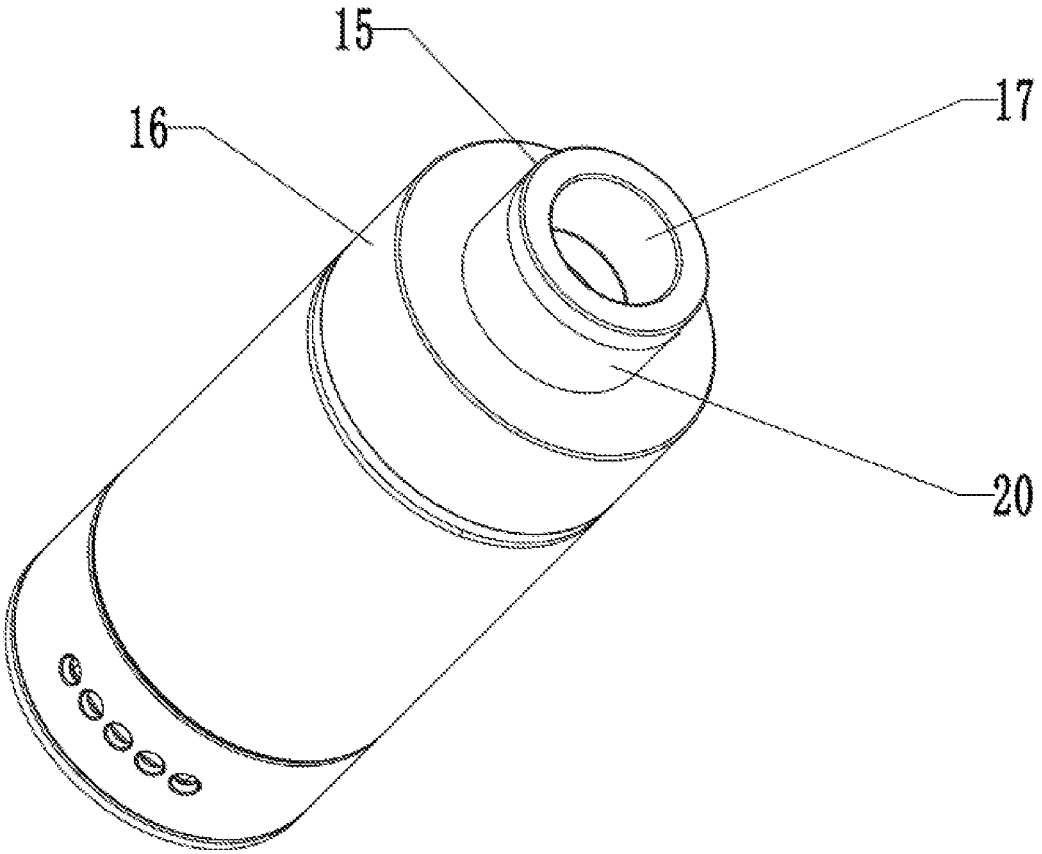
FIG. 8 is a perspective schematic view of an atomizer comprising the cigarette mouthpiece shown in FIG. 7.
Figure 9:
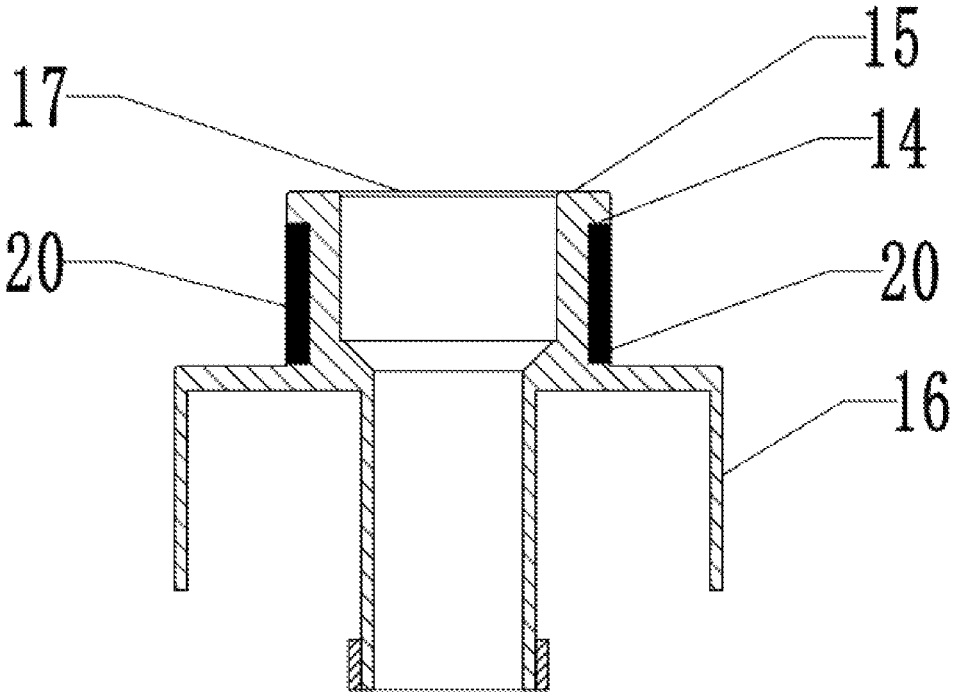
FIG. 9 is a cross-sectional view of the cigarette mouthpiece shown in FIG. 7 in the A-A direction.

As shown in FIGS. 7-9, in another embodiment, the hard substrate 10 has an approximately cylindrical shape and comprises an upper section 15 and a lower section 16. The diameter of the lower section 16 is larger than that of the upper section 15. A through hole is defined inside the hard substrate 10 and extends through the upper section 15 and the lower section 16. The top end of the through hole is the smoke outlet 17. A groove 14 is defined on the outside of the upper section 15 along the circumferential direction of the upper section 15. The soft substrate 20 is mounted on the outside of the upper section 15 along the circumferential direction of the upper section 15. Specifically, the soft substrate 20 has a sleeve shape and located in the groove 14. When the soft substrate 20 is mounted in the groove 14, the outer surface of the entire upper section 15 becomes a smooth curved surface.

In one embodiment, there is no concave portion 18 defined on the hard substrate 10. That is, between the top end 11 and the bottom end 12, there is no curved surface or planar surface defined inclining to the central axis of the cigarette mouthpiece. Furthermore, the shape of the hard substrate 10 is selected from one of a group of cylinder, frustum of a prism and frustum of a cone. Furthermore, a groove 14 is defined on the hard substrate 10, and the soft substrate 20 is mounted in the groove 14. Alternatively, there is no groove 14 defined on the hard substrate 10, and the soft substrate 20 is directly mounted on the hard substrate 10.

In one embodiment, the connection method between the soft substrate 20 and the hard substrate 10 includes, but is not limited to, adhesion and sleeving.

In one embodiment, a cartomizer is provided. The cartomizer comprises a main body 31 and a cigarette mouthpiece mounted on the top end of the main body 31. A liquid storage chamber is defined in the main body 31. The cigarette mouthpiece is any one of the cigarette mouthpieces described in the previous embodiments.

In one embodiment, an electronic cigarette is provided which comprises a cartomizer described in the previous embodiment.

In one embodiment, an electronic cigarette is provided which comprises a cigarette mouthpiece described in any one of the previous embodiments.

The cigarette mouthpiece provided in the present disclosure comprises a hard substrate 10 and a soft substrate 20 mounted on the hard substrate 10. Accordingly, the user's lips can obtain soft and comfortable tactility when in contact with the cigarette mouthpiece. At the same time, the use of the hard substrate 10 in cooperation with the soft substrate 20 ensures the reliability of the cigarette mouthpiece, reduces the risk of contamination and prolongs the service life.

Referring to FIGS. 10-12 and 17, the present disclosure further provides an electronic cigarette 100. The electronic cigarette 100 includes a cartomizer and a power supply device 41 electrically connected to the cartomizer, the cartomizer includes a main body 31 and a mouthpiece disposed at the top end of the main body 31. The main body 31 is provided with a liquid storage chamber 49 therein. In one embodiment, the cigarette mouthpiece can be the cigarette mouthpiece of any of the preceding embodiments. It will be appreciated that in other embodiments not shown, the cartomizer may also be named as an atomizer. The cigarette mouthpiece is disposed at one end of the main body 31, the other end of the main body 31 opposite to the cigarette mouthpiece is detachably connected to the power supply device 41. In one embodiment, the cross-section of the cartomizer is substantially hexagonal, and/or the cross-section of the power supply device 41 is substantially hexagonal.

Referring to FIGS. 12-14 and 21-24, the electronic cigarette 100 provided in this embodiment has a flat prismatic shape as a whole, therefore the electronic cigarette 100 has better anti-rolling performance during placement or storage. The radial cross-section of the electronic cigarette 100 is substantially hexagonal, a pair of angles of the hexagon are acute, the other two pairs of opposite angles are obtuse, the opposite sides of the hexagon are parallel to each other. Specifically, the electronic cigarette 100 includes a first surface 61, a second surface 62, a third surface 63, a fourth surface 64, a fifth surface 65, and a sixth surface 66. The first surface 61 and the second surface 62 are parallel to each other and symmetrically disposed about a central axis of the electronic cigarette 100. The third surface 63 and the fourth surface 64 are parallel to each other, the fifth surface 65 and the sixth surface 66 are parallel to each other. The two opposite sides of the third surface 63 are respectively connected to the first surface 61 and the sixth surface 66. One side of the sixth surface 66 away from the third surface 63 is connected to the second surface 62. The two opposite sides of the fifth surface 65 are connected to the first surface 61 and the fourth surface, respectively. The side of the fourth surface 64 away from the fifth surface 65 is connected to the second surface 62.

The surface (61, 62, 63, 64, 65, 66) are both flat surfaces, the area of the first surface 61 and the area of the second surface 62 are equal, the area of the first surface 61 or the second surface 62 is larger than any one of the surfaces (63, 64, 65, 66). The third surface 63, the fourth surface 64, the fifth surface 65, and the sixth surface 66 are equal in the surface area. Therefore, the user can smoothly place the electronic cigarette through the first surface 61 or the second surface 62 to prevent the electronic cigarette from arbitrarily rolling. The angle between the first surface 61 and the third surface 63, the angle between the first surface 61 and the fifth surface 65 are both obtuse angles. The angle between the second surface 62 and the fourth surface 64, and the angle between the second surface 62 and the sixth surface 66 are also obtuse angles. The angle between the third surface 63 and the sixth surface 66, and the angle between the fourth surface 64 and the fifth surface 65 are both acute angles.

When the user holds the electronic cigarette, the angle between the first knuckle near the palm and the second knuckle connected to the first knuckle is an acute angle, the angle between the third knuckle away from the palm and the second knuckle is an obtuse angle. Thus, the first knuckle and the second knuckle are respectively attached to the fifth surface 65 and the fourth surface 64, the third knuckle is attached to the second surface 62. Alternatively, the first knuckle and the second knuckle are respectively attached to the sixth surface 66 and the third surface 63, the third knuckle is attached to the first surface 61, which is ergonomic and makes the user's grip feel better.

Furthermore, a curved connection is used between adjacent surfaces. Specifically, a curved connection is connected between two adjacent surfaces (61, 62, 63, 64, 65, 66), which make the connections therebetween more smooth, and provides the user a good holding feeling. The distance between the first surface 61 and the second surface 62 is shorter than the distance between the third surface 63 and the fourth surface 64. The distance between the first surface 61 and the second surface 62 is also shorter than the distance between the fifth surface 65 and the sixth the surfaces 66. The distance between the third surface 63 and the fourth surface 64 is equal to the distance between the fifth surface 65 and the sixth surface 66. Therefore, the electronic cigarette 100 is approximately flat, the user can directly pinch the first surface 61 and the second surface 62 in use.

Figure 10:
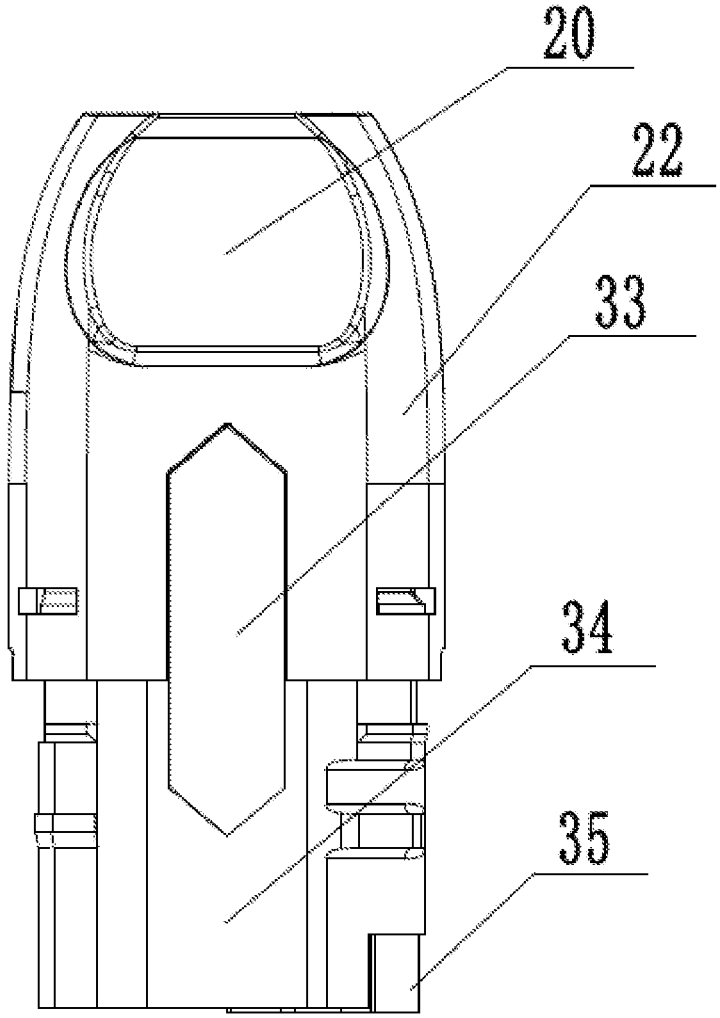
FIG. 10 is a front view of a cartridge of a further embodiment.
Figure 11:
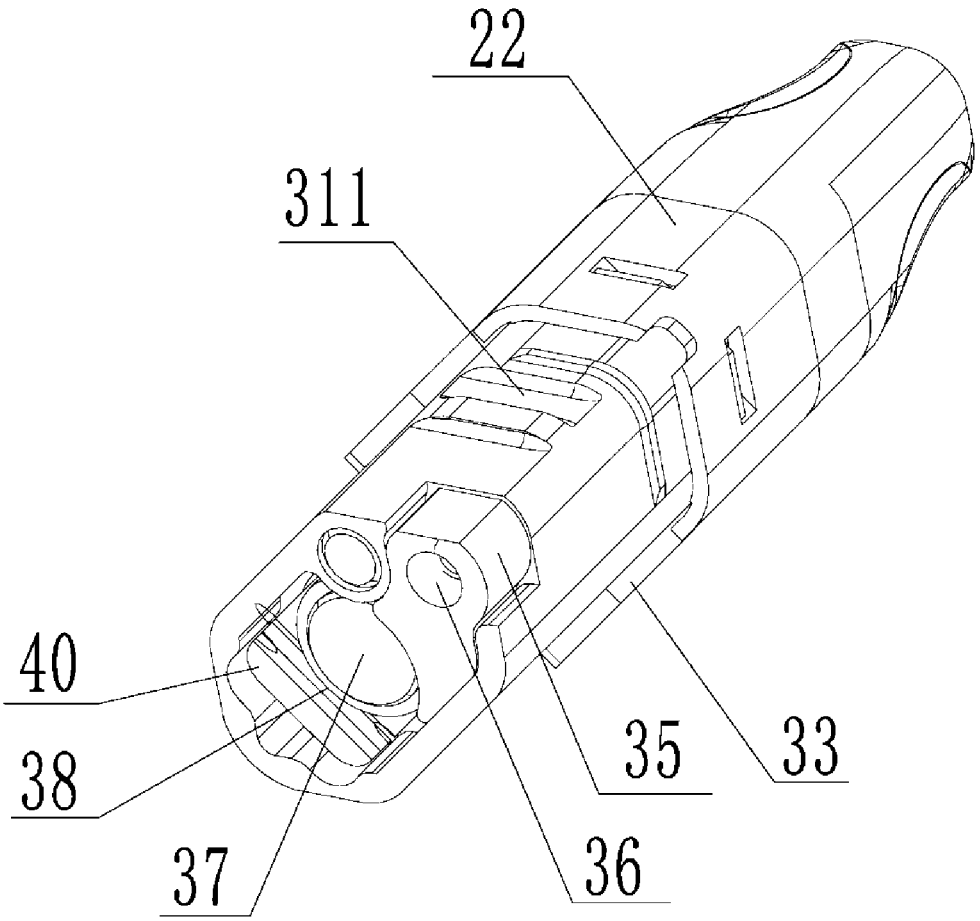
FIG. 11 is a perspective view of the cartridge shown in FIG. 10.

Referring to FIG. 10 and FIG. 11, the cartomizer of the present embodiment includes the main body 31 and the cigarette mouthpiece disposed at the top end of the main body 31. The cigarette mouthpiece includes a mouthpiece cover 22 and a soft substrate 20, wherein the mouthpiece cover 22 is the hard substrate 10 described in the above-described implementation.

Figure 17:
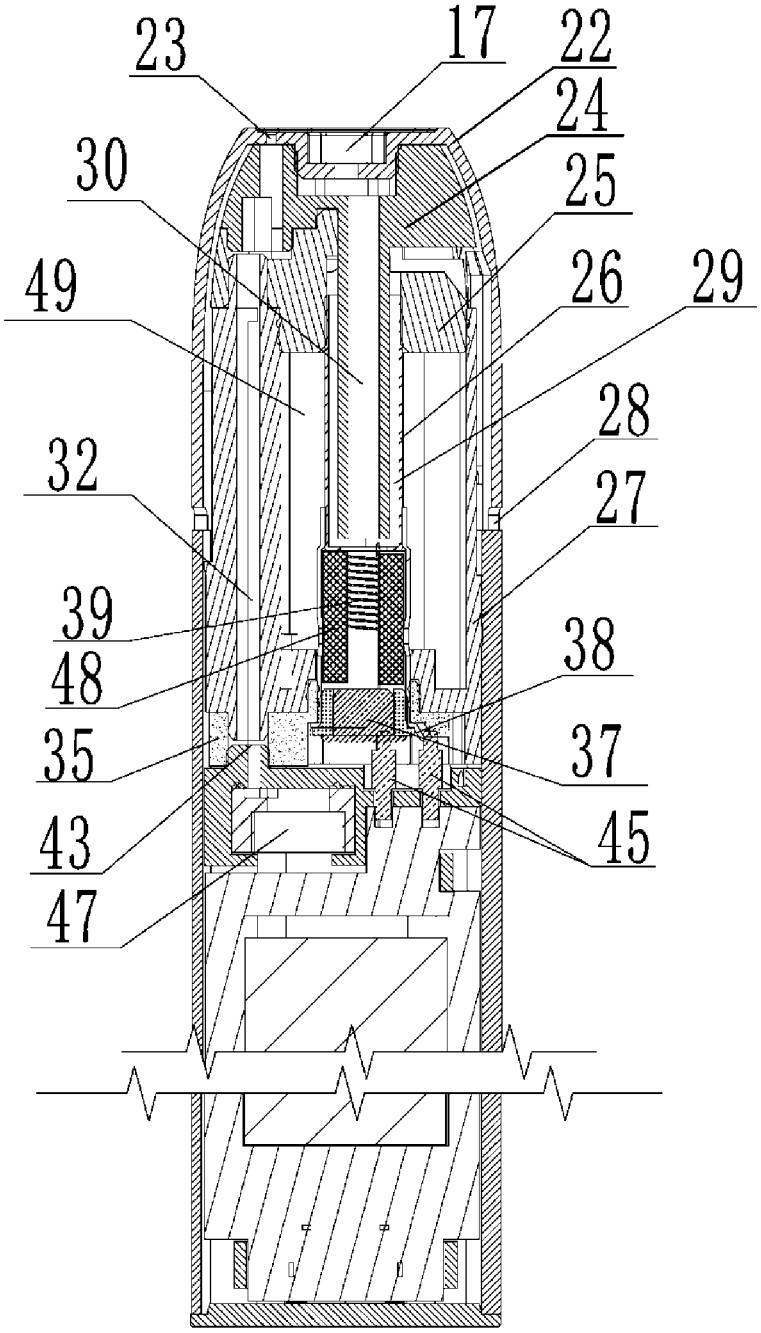
FIG. 17 is a cross-sectional view of the electronic cigarette of FIG. 13 taken along the line A-A.

Referring to FIG. 17, the main body 31 further includes a housing 27 having a hollow cylindrical structure with an opening at its upper end. The housing 27 provides at least one liquid storage chamber 49 located therein. The main body 31 is mainly composed of a first sealing member 25 and a housing 27, the first sealing member 25 is disposed at the upper end of the housing 27, the lower end of the housing 27 is provided with a second sealing member 35. The space enclosed by the second sealing member 35, the housing 27 and the first sealing member 25 is the liquid storage chamber 49 for storing an aerosol-forming substrate such as nicotine-containing cigarette liquid or nicotine-free cigarette liquid.

The bottom of the housing 27 is provided with a liquid injection hole 491 in communication with the liquid storage chamber 49. A liquid injection plug 492 is disposed in the liquid injection hole 491. The vaporizable material, such as the cigarette liquid, can be injected into the liquid storage chamber 49 via the liquid injection hole 491, and then the liquid injection hole 491 is sealed by the liquid injection plug 492. Or, the liquid injection hole 491 is sealed by the liquid injection plug 492 in advance, and the liquid injection plug 492 is pierced by an injection needle to inject the vaporizable material into the liquid storage chamber 49. After injection, the liquid injection needle is pulled out, and then the liquid injection plug 492 is self-restored and sealed. The housing 27 is made of a transparent or translucent material. In the embodiment, the housing 27 is made of transparent or translucent plastic, such as polycarbonate (PC), polyetherimide (PEI) or polyether. Sulfone resin (PES).

Figure 12:
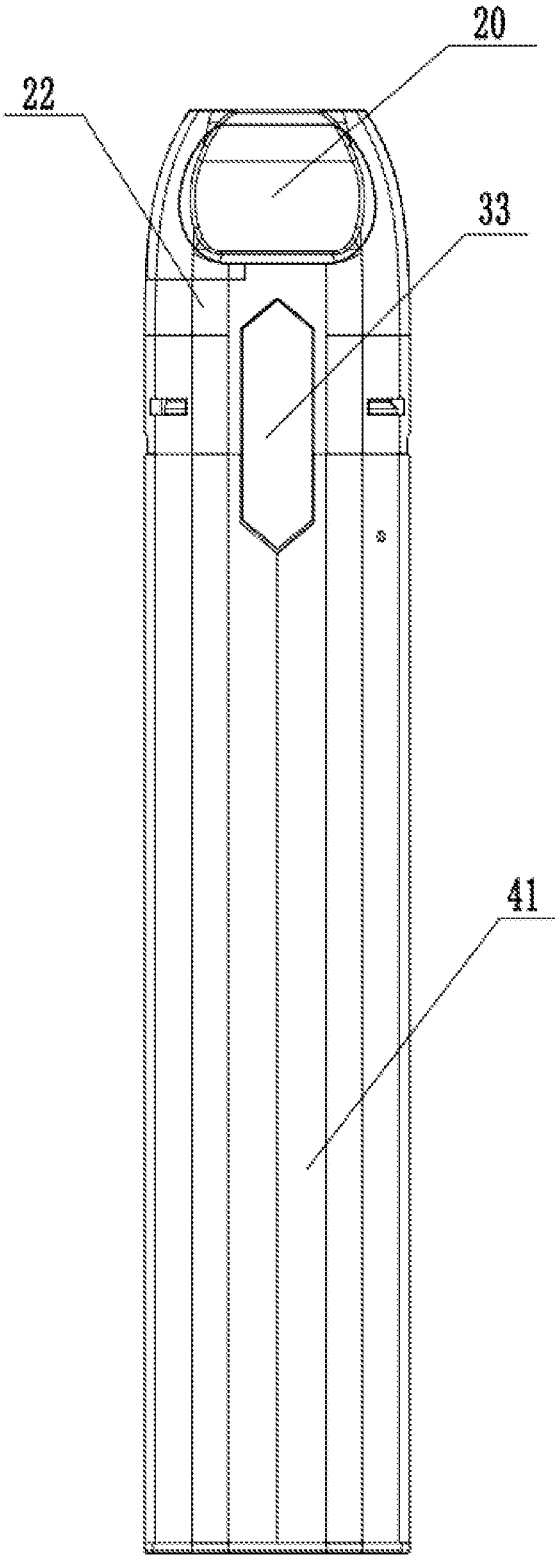
FIG. 12 is a front view of an electronic cigarette according to a still further embodiment.
Figure 13:
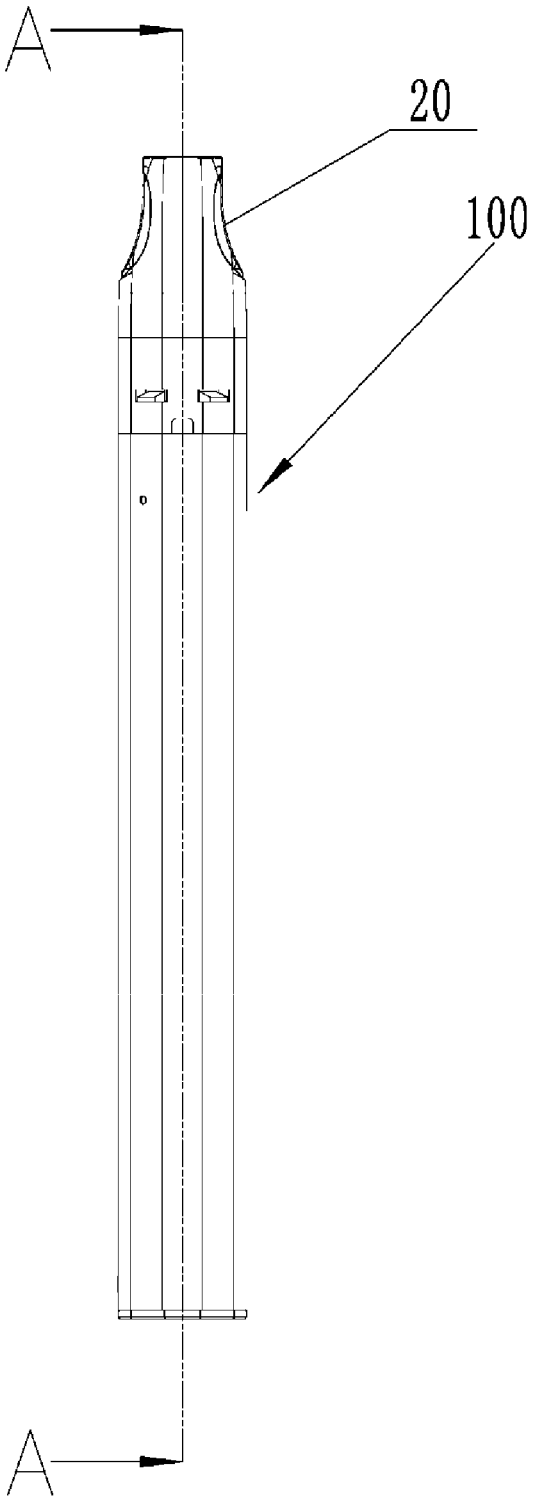
FIG. 13 is a side view of the electronic cigarette shown in FIG. 12.
Figure 14:
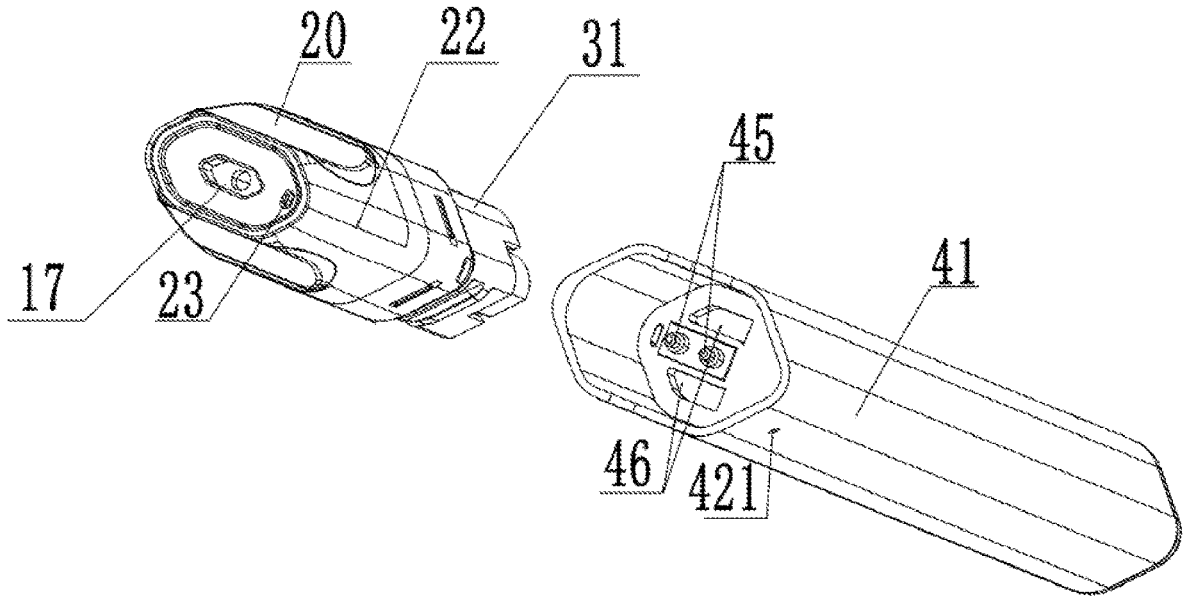
FIG. 14 is an exploded perspective view of the cartridge and the power supply device of the electronic cigarette shown in FIG. 12.
Figure 18:
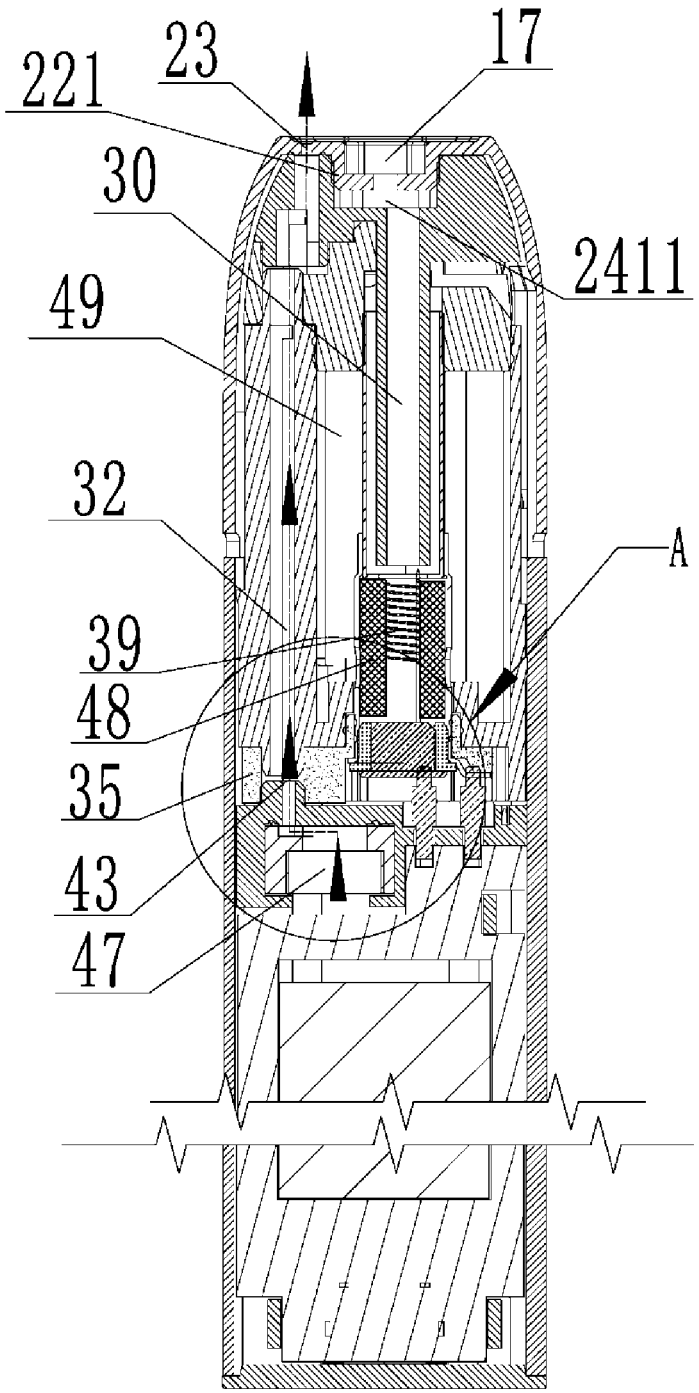
FIG. 18 is a cross-sectional view of the induction air passage of the electronic cigarette shown in FIG. 12.

Referring to FIGS. 12, 13, and 18, when the cartomizer is inserted into the power supply device 41, an electronic cigarette 100 is formed. In the embodiment, the electronic cigarette 100 provides a sensor instead of a mechanical button to trigger the conduction of the atomizing circuit of the electronic cigarette 100. When the user inhales through the cigarette mouthpiece, due to the change of the airflow velocity or the air pressure, a sensor 47 is triggered to generate a signal and send the signal to the PCB control board in the power supply device 41. The PCB control board controls the atomization circuit to conduct, so that the vaporizable material is atomized to form smoke for the user to smoke. The sensor 47 can be an air flow sensor or an air pressure sensor.

Figure 19:
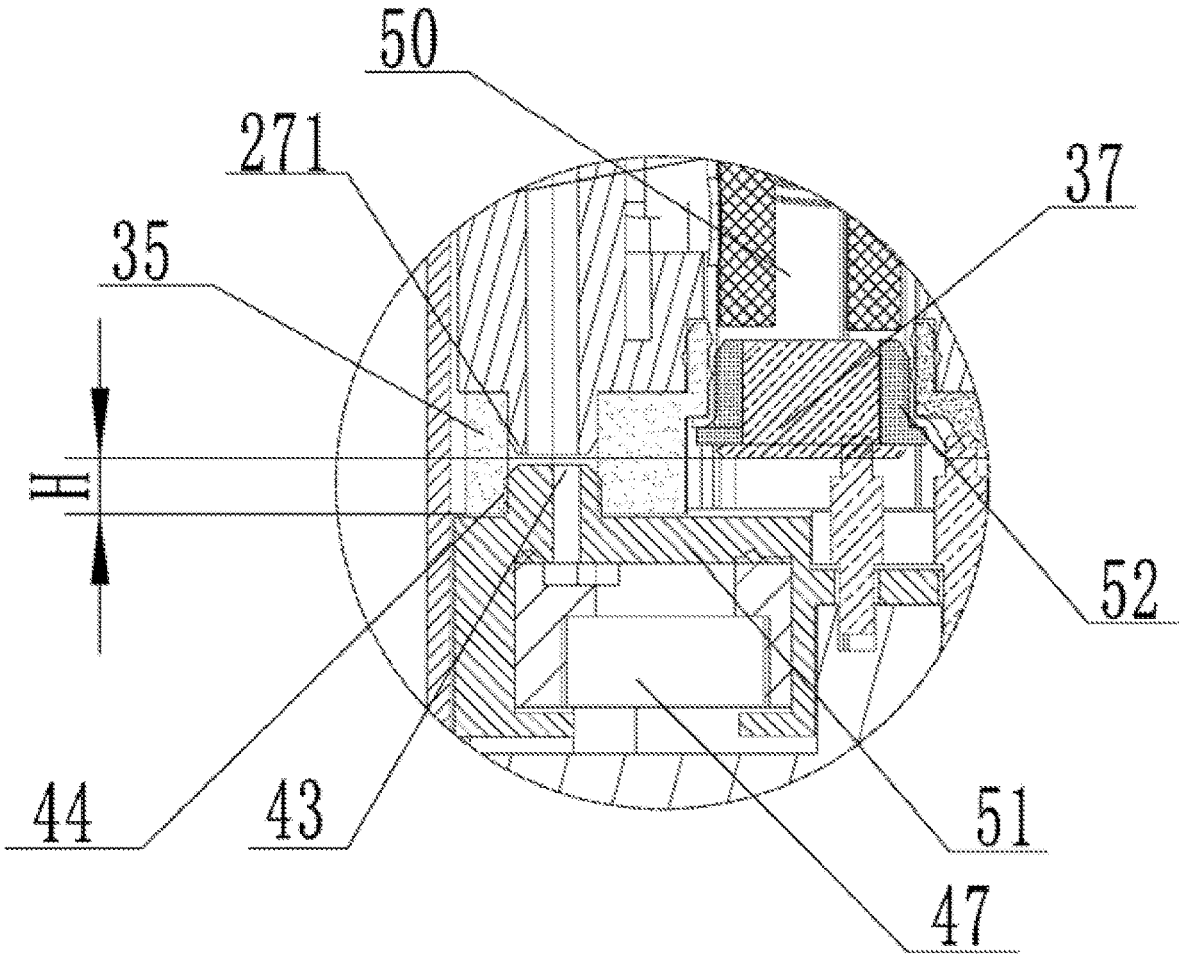
FIG. 19 is a partial enlarged view of the portion A in FIG. 18.

Referring to FIG. 18 and FIG. 19, the sensor 47 is disposed in the power supply device 41. Specifically, the sensor 47 is located in the sensor mounting base 51, the sensor mounting base 51 and the cartomizer are connected to one end of the power supply device 41, respectively. That is, the sensor mounting base 51 is close to the cartomizer. The USB socket is located at one end of the power supply device 41 away from the cartomizer, so that the sensor 47 is close to the cigarette mouthpiece, the distance between the sensor 47 and the cigarette mouthpiece is shortened, which is advantageous for sealing air passage. Referring to FIG. 19, one side of the outer surface of the sensor mounting base 51 towards to the cartomizer is partially extended upwards, that is, the sensor mounting base 51 extends upward to form an extension seat 44. The extension seat 44 is hollow inside and is in communication with the accommodating cavity of the sensor mounting base 51 for mounting the sensor 47.

Referring to FIG. 11, the second sealing member 35 is provided with a first induction air passage through hole 36. Further referring to FIGS. 17-19, the lower end of the housing 27 is defined with an extension port 271 inserted into the second sealing member 35, the first induction air passage through hole 36 defined in the second sealing member 35 is communication with the extension port 271. The housing 27 is provided an induction air passage 32 therein. Specifically, the induction air passage 32 is located in the wall of the housing 27 along the axial direction of the housing 27, the induction air passage 32 is isolated from the liquid storage chamber 49. The lower end of the induction air passage 32 is the extension port 271 for sensing the air passage. The two opposite ends of the induction air passage 32 are respectively extended through the upper and lower ends of the housing 27. The two opposite ends of the induction air passage 32 are inserted into the first sealing member 25 and the second sealing member 35, respectively. The first sealing member 25 and the second sealing member 35 are made of sealing material, such as silicone or rubber, whereby the sealing of the induction air passage 32 can be improved.

The airtight member 24 is disposed at an upper end of the first sealing member 25. The airtight member 24 includes a sealing portion 241 and an insertion portion 242. The insertion portion 242 extends downward from the lower surface of the sealing portion 241, that is, the insertion portion 242 is vertically disposed along the axial direction of the cartomizer and protrudes toward the power supply device 41. The sealing portion 241 covers the upper surface of the housing 27 and the first sealing member 25, the airtight member 24 is also provided with a through hole, through which the induction air passage 32 is in communication with the outside. Specifically, the through hole is provided in the sealing portion 241 and extends through the upper and lower end faces of the sealing portion 241. The insertion portion 242 extends through the first sealing member 25 and into the interior of the housing 27.

The mouthpiece cover 22 is disposed outside of the airtight member 24, specifically, the mouthpiece cover 22 is a hollow cylindrical structure with a lower end opening. The mouthpiece cover 22 is sleeved outside of the sealing portion 241, the first sealing member 25 and the housing 27. The mouthpiece cover 22 and the housing 27 are clasped with each other. When the mouthpiece cover 22 and the housing 27 are connected in position, the upper end surface of the mouthpiece cover 22 at least partially abuts against the sealing portion 241. The upper end surface of the mouthpiece cover 22 is provided with a smoke outlet 17 in communication with the outlet passage 30 and an air outlet 23 in communication with the induction air passage 32. The upper end portion of the sealing portion 241 is recessed downward to form a communication groove 2411. The communication groove 2411 and the through hole of the sealing portion 241 are located at the same side of the sealing portion 241. The upper end of the outlet passage 30 extends through the groove bottom wall of the communication groove 2411 and in communication with the communication groove 2411. The induction air passage 32 is in communication with the air outlet 23 through the through hole of the sealing portion 241. The mouthpiece cover 22 is provided with a communication pipe 221 corresponding to the smoke outlet 17, the communication pipe 221 and the air outlet 23 are located at the same side of the mouthpiece cover 22, the communication pipe 221 is disposed axially downward along the mouthpiece cover 22 and has openings at opposite ends. The upper end opening of the communication pipe 221 is the smoke outlet 17. The vertical portion of the communication pipe 221 and the peripheral wall of the communication groove 2411 are attached to each other, that is, the communication pipe 221 is inserted into the communication groove 2411, the air outlet 23 is isolated from the smoke outlet 17 on the inner side of the mouthpiece cover 22. Thereby, the induction air passage 32 and the outlet passage 30 (i.e., the inner cavity of the insertion portion 242) are effectively isolated on the mouthpiece cover 22. The lower end opening of the communication pipe 221 and the upper end opening of the smoke outlet passage 30 are arranged offset with respect to one another, such that the smoke can be prevented from directly rushing out of the smoke outlet 17 and causing the user to be choked by the smoke.

In the embodiment, the soft substrate 20 and the airtight member 24 are integrally molded, the soft substrate 20 and the airtight member 24 are made of silicone rubber or rubber. Specifically, the soft substrate 20 includes a fixed end 201 and a movable end 202 corresponding to the fixed end 201. The fixed end 201 is disposed on the sealing portion 241, the movable end 202 is movable relative to the airtight member 24. The inner surface of the movable end 202 extends downward in the axial direction of the cartomizer to form a convex portion 203, the opposite sides of the mouthpiece cover 22 are provided with a groove 14, respectively.

When installation, the mouthpiece cover 22 is sleeved outside of the airtight member 24, the shape of the soft substrate 20 matches the shape of the groove 14. Two soft substrates 20 are respectively embedded in the corresponding grooves 14. The convex portion 203 abuts against the inner wall of the mouthpiece cover 22 to fix the movable end 202, to prevent the movable end 202 from moving freely relative to the mouthpiece cover 22. When the user inhales, the lips are attached to the soft substrate 20, which makes the user's experience better. Since the soft substrate 20 and the airtight member 24 are integrally molded, it is easy to produce the soft substrate 20 and the airtight member 24, the installation of the soft substrate 20 and the airtight member 24 is also simpler and more convenient.

The outlet passage 30 is labeled in both FIGS. 17 and 18. Specifically, the outlet passage 30 is the inner cavity of the insertion portion 242. The outlet passage 30 is finally in communication with the smoke outlet 17 at the upper end of the electronic cigarette 100.

Figure 20:
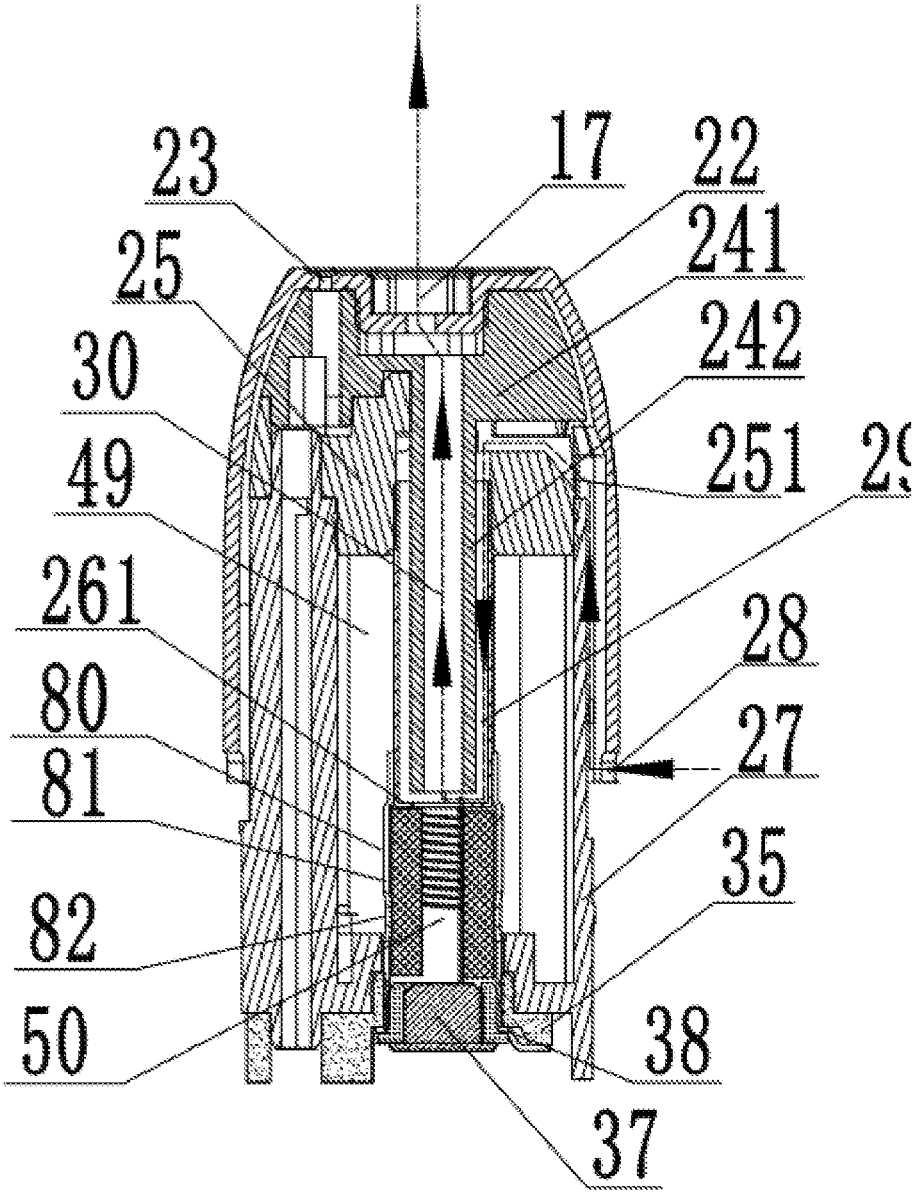
FIG. 20 is a cross-sectional view of the cartridge of the electronic cigarette shown in FIG. 12.
Figure 21:
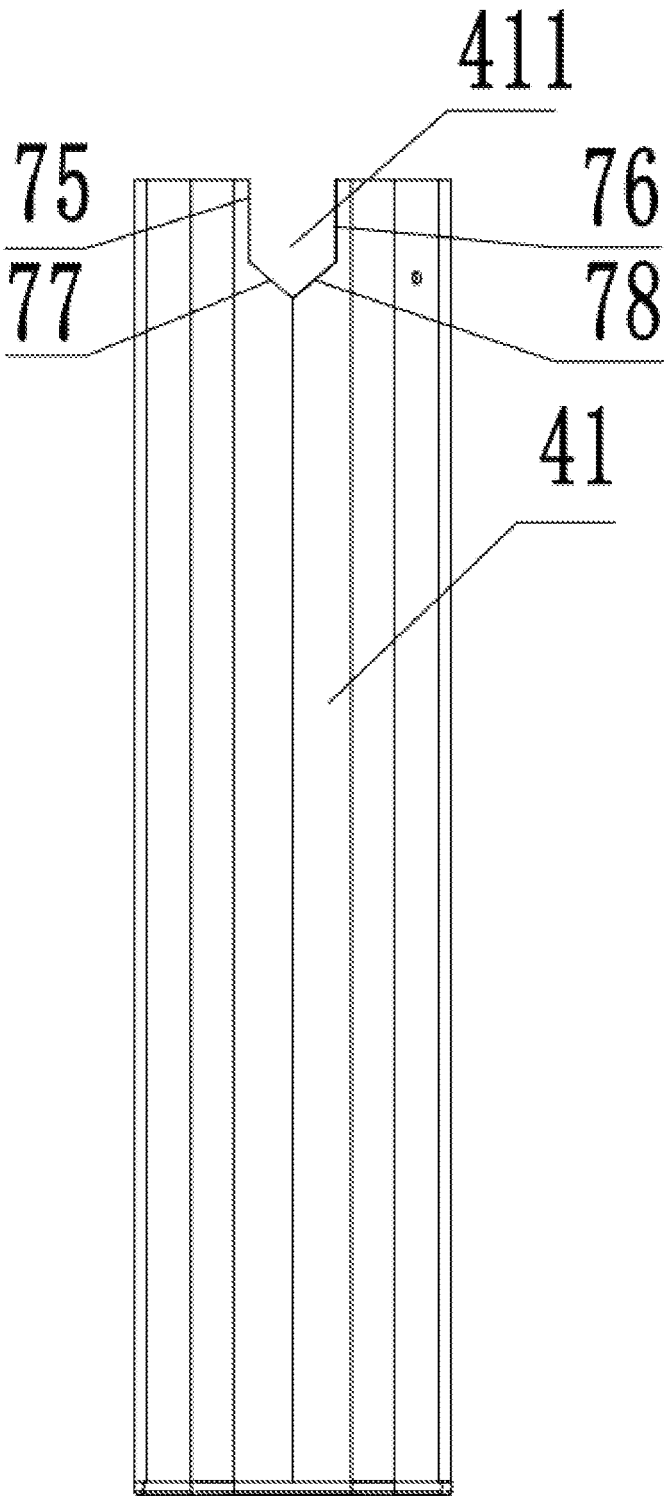
FIG. 21 is a front view of the power supply device of the electronic cigarette shown in FIG. 12.
Figure 22:
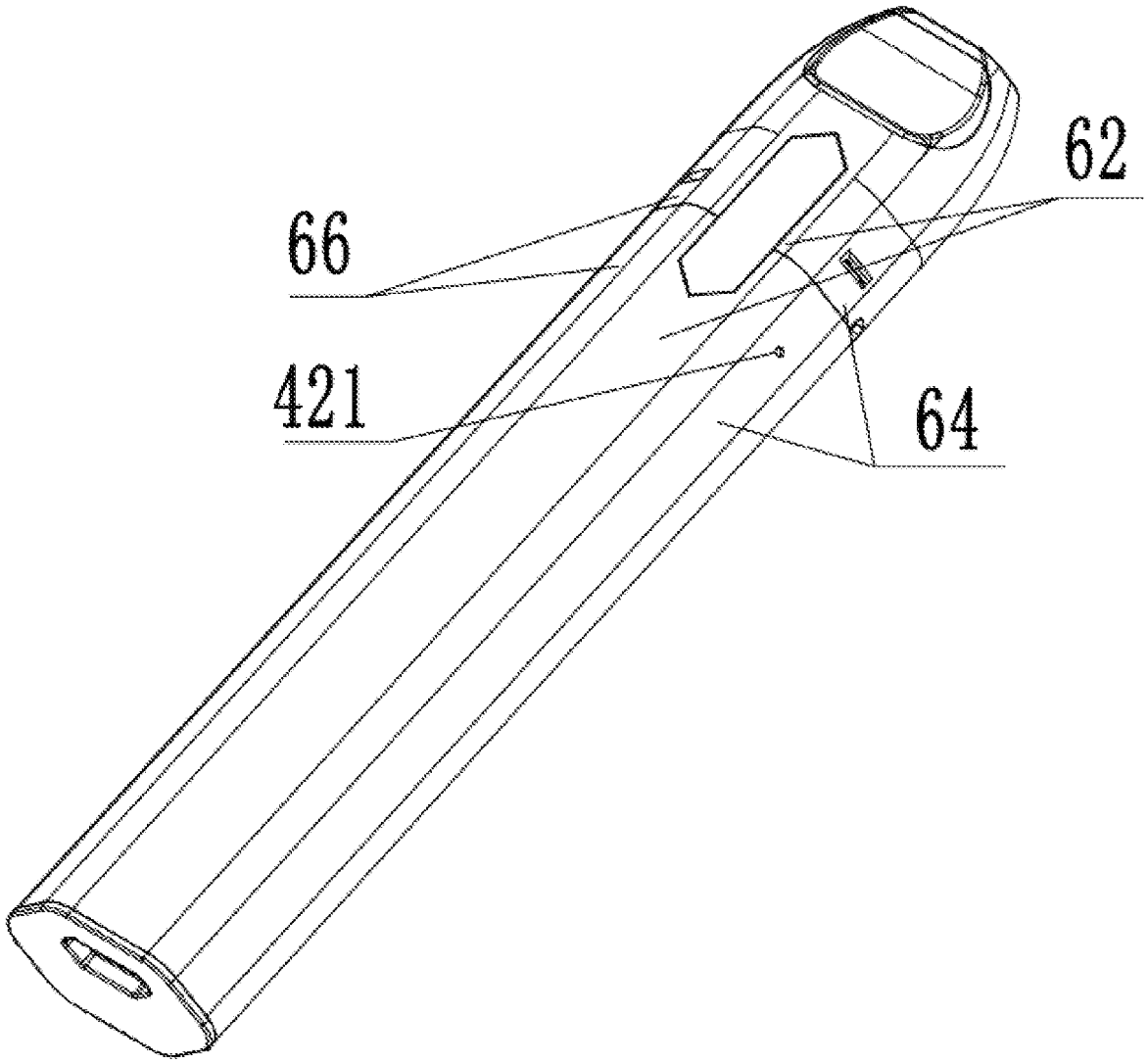
FIG. 22 is a perspective view of the electronic cigarette shown in FIG. 12.
Figure 23:
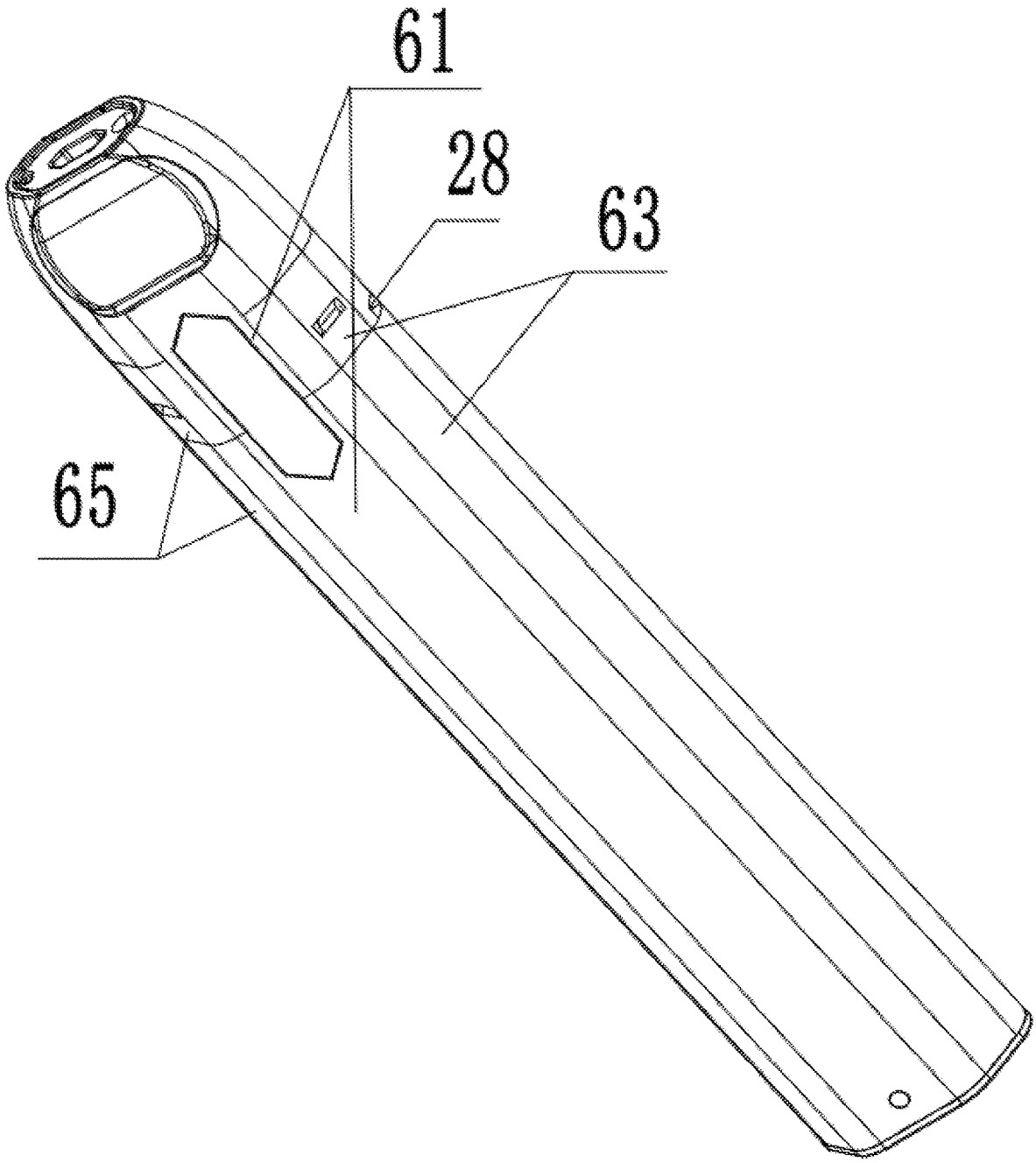
FIG. 23 is a schematic perspective view showing another perspective of the electronic cigarette shown in FIG. 12.
Figure 24:
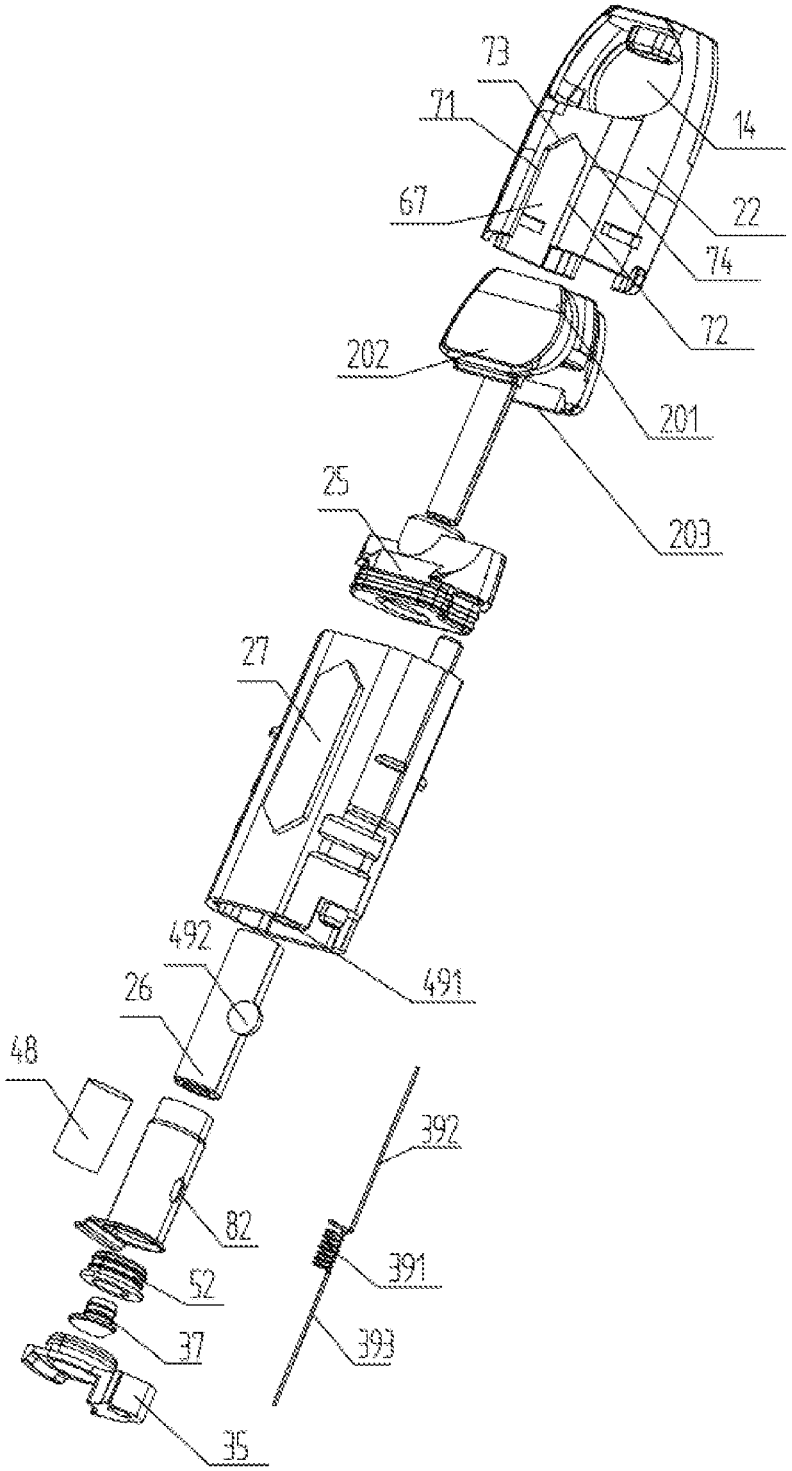
FIG. 24 is an exploded view of the cartridge of the electronic cigarette shown in FIG. 12.

Referring FIG. 20, the mouthpiece cover 22 is provided with an air inlet 28 at one end thereof. The lower portion of the mouthpiece cover 22, the housing 27 and the first sealing member 25 are provided with a gap therebetween, through which the external air passes from the air inlet 28 to the cartomizer. A vent tube 26 is disposed on the outer side of the insertion portion 242. Specifically, the upper end of the vent tube 26 is inserted into the first sealing member 25, the lower end of the vent tube 26 is in communication with the atomizing head 80. The vent tube 26 is sleeved outside of the insertion portion 242, the intake passage 29 includes the gap passage located between the insertion portion 242 and the vent tube 26. See FIG. 20, the broken line with the arrow indicates the flow direction of the airflow when the cartomizer is sucked. The intake passage 29 further includes a gap between the mouthpiece cover 22 and the housing 27, a notch 251 of the first sealing member 25, the gap between the first sealing member 25 and the sealing portion 241, and the gap between the first sealing member 25 and the insertion portion 242.

An atomizing head 80 is disposed below the insertion portion 242, one end of the atomizing head 80 is fixedly disposed at a lower end of the housing 27, the atomizing head 80 is housed in the liquid storage chamber 49. The atomizing head 80 includes an atomizing sleeve 81, a liquid absorbing member 48 and a heating element 39. The liquid absorbing member 48 and the heating element 39 are housed in the atomizing sleeve 81, the two opposite ends of the atomizing sleeve 81 and the vent tube 26 are respectively in communication with the lower end of the vent tube 26 and the bottom of the housing 27. The upper end of the vent tube 26 is connected to the first sealing member 25. The liquid absorbing member 48 absorbs the cigarette liquid from the liquid storage chamber 49 via a liquid guiding hole 82 of the atomizing sleeve 81 and supplies the cigarette liquid to the heating element 39. When the atomizing circuit is turned on, the heating element 39 can heat the cigarette liquid absorbed by the liquid absorbing member 48 under the electric drive of the power supply device 41 to form smoke, and the smoke flows out from the cigarette mouthpiece for the user to smoke.

In one embodiment, the liquid absorbing member 48 is wrapped on the outside of the heating element 39. The heating element 39 is a spiral, hollow tubular heating wire, and the hollow portion located in the heating element 39 forms an atomizing chamber 50, the smoke is formed in the atomizing chamber 50.

When inhales, the external airflow entering from the intake passage 29 can carry away the smoke formed in the atomizing chamber 50 and flow out of the outlet passage 30. The heating element 39 can a metal heating wire, such as nickel wire, a stainless steel wire, a nichrome wire or a brass wire. The atomizing sleeve 81 and the second electrode 37 can be made of brass or stainless steel, the stainless steel can be 316 stainless steel or 304 stainless steel, which have good corrosion resistance and are environmentally friendly. The lower end of the vent tube 26 is provided with a limiting boss 261 for limiting the liquid absorbing member 48 during mounting the liquid absorbing member 48. The second electrode 37 is mounted in the lower end of the atomizing sleeve 81, the insulating member 52 is clamped between the second electrode 37 and the atomizing sleeve 81.

Referring to FIG. 19, the lower surface of the second electrode 37 of the cartomizer and the lower surface of the second sealing member 35 are arranged offset with respect to one another along the longitudinal axis of the cartomizer, the spacing between the two surfaces is H. That is, the two surfaces are not in a horizontal plane, the lower surface of the second sealing member 35 is closer to the power supply device 41, that is, the lower surface of the second sealing member 35 is disposed lower.

Referring to FIGS. 17, 18 and 20, the atomizing chamber 50 is located above the second electrode 37, so that the cigarette liquid, formed by the condensation of the smoke that has not been sucked by the user, may be flow out through the gap between the second electrode 37 and the insulating member 52. Since the lower surface of the second sealing member 35 is disposed lower, and as described above, after the cartomizer is inserted into the cartomizer receiving chamber 412, the extension seat 44 can be inserted or at least partially inserted into the second sealing member 35 to seal the outer circumference of the induction air passage 32. The second sealing member 35 encloses the extension seat 44 to prevent cigarette liquid from flowing into the sensor mounting base 51 via the second induction air passage through hole 43 and the first induction air passage through hole 36, further avoiding the sensitivity of the sensor 47 due to the contamination of the cigarette liquid.

In one embodiment, the second sealing member 35 can be made of silicone rubber or rubber having elastic properties, to improve the sealing performance. The second electrode 37 functions as the positive electrode, the negative electrode contact 38 functions as the negative electrode. The polarity of the electrode of the second electrode 37 and the negative electrode contact 38 of the cartomizer can be interchanged, the second electrode 37 and the negative electrode contact 38 constitute an electrode contact assembly of the cartomizer. In another embodiment not shown, the second electrode 37 is a negative electrode contact, the negative electrode contact 38 is a positive electrode contact.

Similarly, as long as the power supply device 41 is capable to supply electric energy to the cartomizer through the two electrode contacts 45. The second electrode 37, and the negative electrode contact 38 electrically connected to the cartomizer. The polarity of the two electrode contacts 45 provided on the power supply device 41 can be also interchanged. The heating element 39 includes a heating section 391, and a first pin 392 and a second pin 393 respectively connected to opposite ends of the heating section 391. The heating section 391 has a spiral cylindrical structure, the liquid absorbing member 48 is wrapped outside the heating section 391.

In the embodiment, the atomizing sleeve 81 and the vent tube 26 are connected to each other to constitute a first electrode, the lower end portion of the atomizing sleeve 81 extends downward to form a negative electrode contact 38. In one embodiment, in order to achieve electrical conduction between the heating element 39, the second electrode 37 and the first electrode, the first pin 392 of the heating element 39 is interposed between the negative electrode contact 38 and the insulating member 52, the second pin 393 of the heating element 39 is interposed between the second electrode 37 and the insulating member 52.

In another embodiment, the second pin 393 is soldered to the second electrode 37, the first pin 392 is soldered to the atomizing sleeve 81 and/or the vent tube 26. The atomizing sleeve 81 and the vent tube 26 are made of conductive material. Specifically, the second pin 393 can be interposed between the second electrode 37 and the insulating member 52 and be spot-welded to the second electrode 37. The first pin 392 is attached to the inner wall of the vent tube 26 and is spot welded to the inner wall of the vent tube 26.

Referring to FIGS. 10, 12, 15, and 21-24, in the embodiment, the housing 27 includes two parts, that is, the window portion 33 and the storage portion 34. The window portion 33 is transparent, the storage portion 34 is opaque or translucence, so that the two are visually distinct. Furthermore, the window portion 33 is convexly outward with respect to the storage portion 34, to make the two further visually different.

It can be understood that, in other embodiments not shown, the window portion 33 may also be recessed inwardly relative to the storage portion 34, or there may be no height difference between the circumferential side of the window portion 33 and the outer surface of the storage portion 34. In order to expose the window portion 33 to make the user can observe the amount of cigarette liquid stored in the storage portion 34 through the window portion 33, the electronic cigarette is further provided with a hexagonal window section located on each of the first surface 61 and the second surface 62. The surfaces (61, 62, 63, 64, 65, 66) of the electronic cigarette respectively include a first segment and a second segment. The first segments of the surfaces (61, 62, 63, 64, 65, 66) are respectively formed by corresponding side surfaces of the mouthpiece cover 22, the surfaces (61, 62, 63, 64, 65, 66) of the second segment are respectively formed by corresponding side surfaces of the outer casing of the power supply device 41.

The window portion can be defined on the first segment of the first surface and the first segment of the second surface, that is, the window portion is defined on the mouthpiece cover 22. Or, the window portion can be defined on the second segment of the first surface and the second segment of the second surface, that is, the window portion is defined on the outer casing of the power supply device 41. Or, one part of the window portion is defined on the first segment of the first surface and the first segment of the second surface. The other party of the window portion is defined on the second segment of the first surface and the second end of the second surface, so that the window portion 33 can be visible through the window portion.

In the embodiment, the window portion includes a first window notch 67 and a second window notch 411. The first window notch 67 is disposed at the lower end of the mouthpiece cover 22, a portion of the window portion 33 is exposed through the first window notch 67, and a portion of the storage portion 34 is shield by the mouthpiece cover 22. When the cartomizer is inserted into the cartomizer receiving chamber 412, the other portion of the storage portion 34 is shield by the outer casing of the power supply device 41, the storage portion 34 is not visible from the outside.

The second window notch 411 corresponding to the window portion 33 is defined at the upper end of the outer casing of the power supply device 41. The shape of the second window notch 411 is adapted to the other portion of the window portion 33. When the cartomizer is inserted into the cartomizer receiving chamber 412, the window portion 33 is exposed through the first window notch 67 and the second window notch 411, so that the user can observe the inside of the liquid storage chamber 49 through the window portion 33.

In addition, since the window portion 33 is convexly disposed on the storage portion 34, during installing the cartomizer into the battery casing, the window portion 33 and the second window notch 411 cooperate to guide the cartomizer mounted in position. It can be understood that, the window portion 33 can be provided only one, accordingly, only one window portion is provided.

The outer casing of the power supply device 41 is made of metal, the mouthpiece cover 22 is made of plastic, thereby making the two visually easy to distinguish. The user's hand is always located in the outer casing of the power supply device 41 regardless of whether the electronic cigarette is held or pinched. The outer casing of the power supply device 41 made of metal gives the user a more delicate and smooth touch.

Each of the window portions includes a first side 73, a second side 74, a third side 77, a fourth side 78, a first vertical side and a second vertical side. The first vertical side and the second vertical side are parallel to each other and are disposed along the axial direction of the electronic cigarette. The first side 73 and the second side 74 are located at the upper ends of the first vertical side and the second vertical side, the third side 77 and the fourth side 78 are located at a lower end of the first vertical side and the second vertical side. The two ends of the first side 73 are respectively connected to the first vertical side and the second side 74. One end of the second side 74 away from the first side 73 is connected to the second vertical side. The opposite ends of the third side 77 are connected to the first vertical side and the fourth side 78, respectively. One end of the fourth side 78 away from the third side is connected with the second vertical side. The first side 73 and the fourth side 78 are parallel to each other, the second side 74 and the third side 77 are parallel to each other.

The angle between the first vertical side and the first side 73, and the angle between the first vertical side and the third side 77 are both obtuse angles. The angle between the second vertical side and the second side 74 and the angle between the second vertical side and the fourth side 78 are both obtuse angles. The angle between the side 73 and the second side 74 and the angle between the third side 77 and the fourth side 78 are both acute angles.

The side lengths of the sides (73, 74, 77, 78) are equal, the side lengths of the first vertical side and the second vertical side are equal, the side length of the first vertical side or the second vertical side is longer than any side lengths of the of the sides (73, 74, 77, 78). In this way, the two hexagonal window portions can be exposed to the window portion 33 more in the axial direction of the electronic cigarette, so that the amount of smoke liquid in the liquid storage chamber 49 can be better observed. Since the window portion includes the first window notch 67 and the second window notch 411, the first vertical side is divided into the fifth side 71 and the sixth side 75, and the second vertical side is divided into the seventh side 72 and the eighth side 76.

There are two first window notches 67, which are respectively defined on the first segment of the first surface 61 and the first segment of the second surface 62. The second window notches 411 corresponding the first window notches 67 are defined in the second segment of the first surface 61 and the second segment of the second surface 62, respectively.

The first window notches 67 respectively extend through the bottom end of the first segment of the first surface 61 and the bottom end of the first segment of the second surface 62. Each of the first window notches 67 includes a first side 73 and a second side 74, the fifth side 71 and the seventh side 72. The fifth side 71 and the seventh side 72 are parallel to each other and are disposed along the axial direction of the electronic cigarette. The opposite two ends of the first side 73 are respectively connected to the fifth side 71 and the second side 74. One end of the second side 74 away from the first side 73 is connected with the seventh side 72. The second window notches 411 respectively extend through the top end of the second section of the first surface 61 and the top end of the second section of the second surface 62. Each of the second window notches 411 includes a third side 77, a fourth side 78, a sixth side 75, and an eighth side 76. The sixth side 75 and the eighth side 76 are parallel to each other and are disposed along the axial direction of the electronic cigarette respectively. The opposite two ends of the third side 77 are connected to the sixth side 75 and the fourth side 78 respectively. One end of the fourth side 78 away from the third side 77 is connected to the eighth side 76.

When the cartomizer is inserted into the cartomizer receiving chamber 412 and is mounted in position, the fifth side 71 and the sixth side 75 located on the same surface are on the same straight line to form a first vertical side; the seventh side 72 and the eighth side 76 located on the same surface are on the same straight line to form a second vertical side. The first side 73 and the fourth side 78 are parallel to each other, the second side 74 and the third side 77 are parallel to each other, that is, each first window notch 67 cooperate with the corresponding second window notch 411 to form a hexagonal window portion.

There are two window portions 33, each of which is matched with a corresponding hexagonal window portion, both of which are hexagonal projections. Since the sixth side 75 and the eighth side 76 are parallel to each other, the cartomizer can be inserted into the cartomizer receiving chamber 412. Furthermore, the side length of the fifth side 71 is equal to the side length of the seventh side 72, the side length of the sixth side 75 is equal to the side length of the eighth side 76, the side length of the fifth side 71 or the seventh side 72 is greater than the side length the sixth side 75 or the eighth side 76, whereby the stroke of the cartomizer insertion is shortened, the user can quickly install the cartomizer. The two hexagonal window portions are symmetrically disposed about the centerline of the first surface 61 and the center line of the second surface 62, respectively, so that the arrangement of the hexagonal window portion is more beautiful.

There are two grooves 14 located adjacent to the smoke outlet 17, the grooves 14 are disposed on the first surface 61 and the second surface 62, respectively. The opposite sides of one groove 14 respectively extend toward the third surface 63 and the fifth surface 65. The opposite sides of the other groove 14 extend toward the fourth surface 64 and the sixth surface 66, respectively. The groove 14 can be embedded with as much soft substrate 20 as possible. The portions of the third surface 63, the fourth surface 64, the fifth surface 65, and the sixth surface 66 that are adjacent to the smoke outlet 17 are contracted toward the central axis of the electronic cigarette respectively, to provide a better sucking experience when the user places the electronic cigarette in the mouth.

Referring to FIGS. 11, 12, 14 and 15, in the electronic cigarette 100 of the present embodiment, the outer side of the cartomizer is provided with a clamping groove 311, the side wall of the cartomizer receiving chamber 412 is correspondingly provided with an engaging projection 42. When the cartomizer is inserted into the cartomizer receiving chamber 412, the engaging projection 42 slides into the clamping groove 311 to limit the axial displacement of the cartomizer.

In one embodiment, the second section of the fourth surface 64 is partially recessed inwardly toward the top thereof to form an indication mark 421, the engaging projection 42 is disposed on the inner side of the second section of the fourth surface 64 corresponding to the indication mark 421. The clamping groove 311 is disposed on the sidewall of the housing 27, whereby the user can accurately insert the cartomizer into the cartomizer receiving chamber 412 according to the indication mark 421 and the clamping groove 311. It can be understood that, the indication mark 421 can also be disposed on other surfaces as long as it corresponds to the position of the engaging protrusion 42.

The air inlet 28 is disposed on a curved surface connecting between the first section of the first surface and the first section of the sixth surface, such that the air inlet 28 is relatively concealed. On the curved surface connecting between the first section of the first surface and the first section of the sixth surface defines an opening having the same shape and size as the air inlet 28, to make the electronic cigarette more beautiful.

Figure 16:
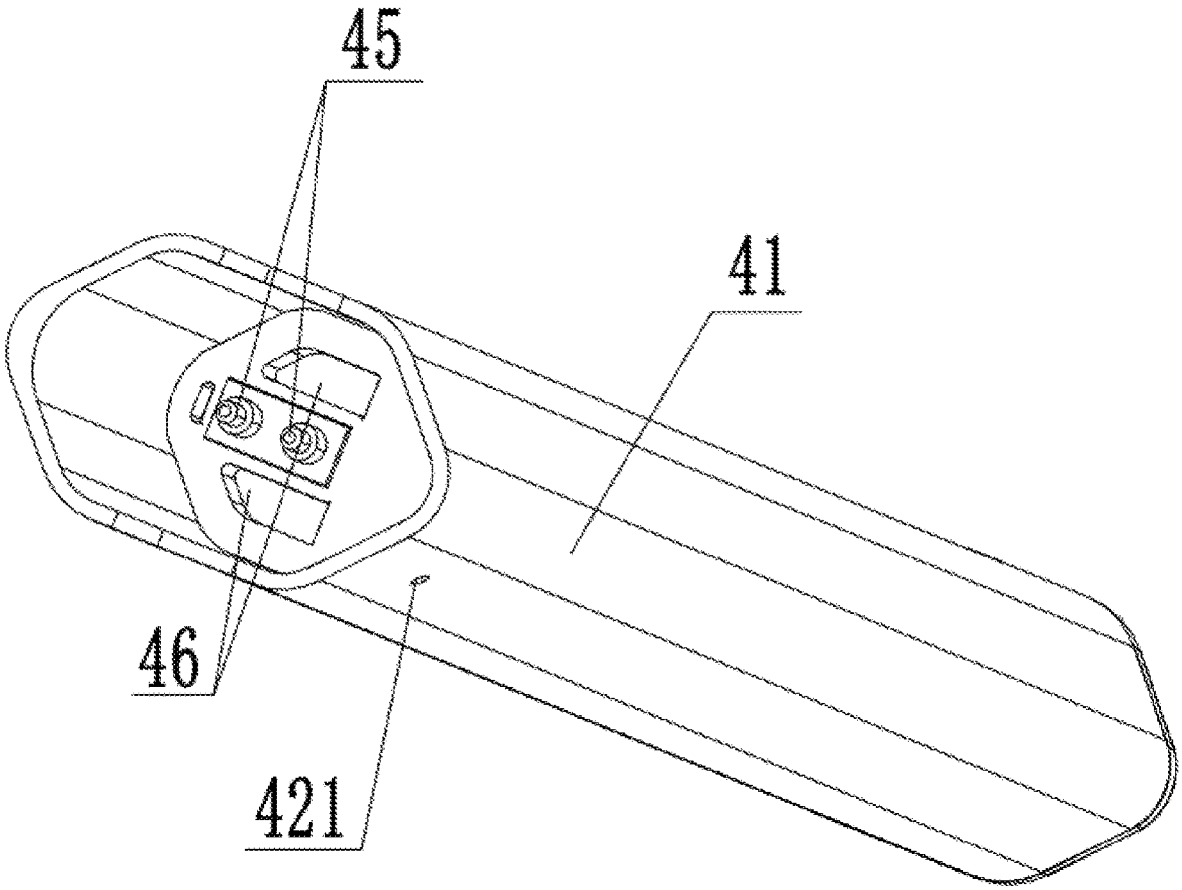
FIG. 16 is a perspective view of another perspective of the power supply device of the electronic cigarette shown in FIG. 12.

In one embodiment, referring to FIG. 11 and FIG. 16, the bottom of the cartomizer receiving chamber 412 is provided with a pre-groove 46. The pre-groove 46 is configured to receive a magnetic body, which can provide a magnetic connection between the cartomizer and the power supply device 41 instead of the clasping connection between the engaging projection 42 and the clamping groove 311.

When the cartomizer is clasping connected to the power supply device 41, the pre-groove 46 is a blind slot, which serves as a receiving groove for receiving the leaked liquid smoke, to avoid the leakage problem caused by the limited capacity of a prefabricated cavity 40 of the cartomizer.

The prefabricated cavity 40 is mainly enclosed by the lower end sidewall of the housing 27 and the side wall of the second sealing member 35 for receiving the second electrode 37 and the negative electrode contact 38 and accommodating a portion of the leaked liquid smoke.

Figure 15:
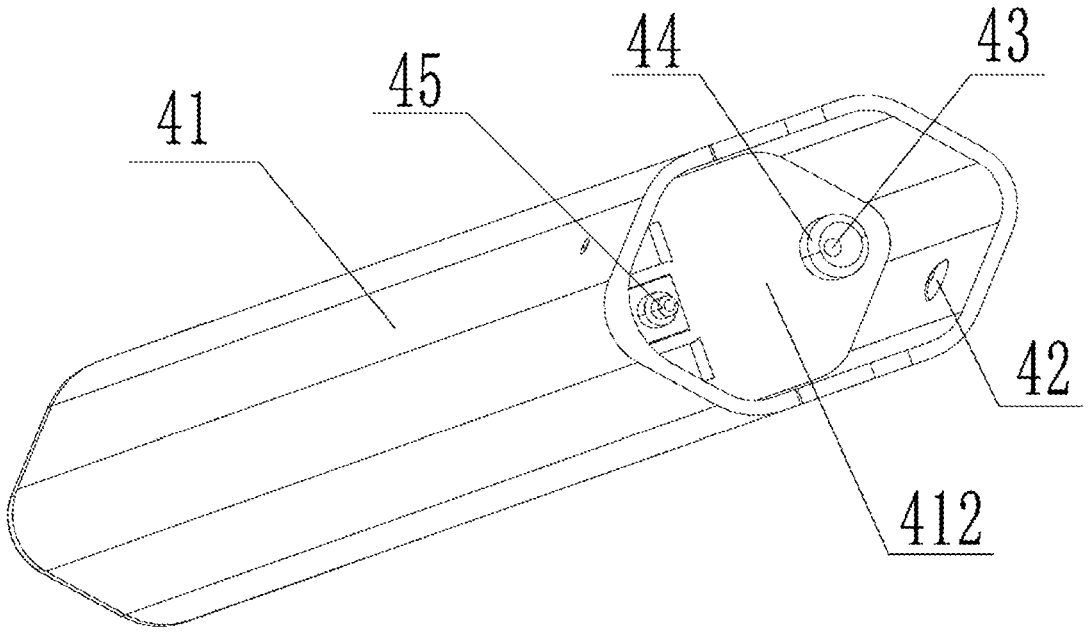
FIG. 15 is a perspective view of the power supply device of the electronic cigarette shown in FIG. 12.

Referring to FIG. 11 and FIG. 15, the first induction air passage through hole 36 is disposed at the bottom of the cartomizer and relatively close to the sidewall of the cartomizer, that is, the first induction air passage through hole 36 is not disposed at the center of the bottom of the cartomizer. Correspondingly, the second induction air passage through hole 43 is not disposed at the center of the cartomizer receiving chamber 412. The extension seat 44 protrudes into the cartomizer receiving chamber 412, thereby only when the first induction air passage through hole 36 is aligned to the second induction air passage through hole 43, the cartomizer can be inserted into the cartomizer receiving chamber 412 and electrically connected. It is assumed that when the first induction air passage through hole 36 and the second induction air passage through hole 43 are arranged offset with respect to one another, the cartomizer cannot be inserted into the cartomizer receiving chamber 412 under the abutment of the extension seat 44.

Any combination made to various embodiments of the present disclosure without departing from the spirit of the disclosure should be regarded as the disclosure of the present disclosure; various simple modifications made to the technical solution or any combination made to the various embodiments without violating the technical spirit of the disclosure is intended to be within the scope of the present disclosure.

The invention claimed is:

1. An electronic cigarette comprising a first surface, a second surface, a third surface, a fourth surface, a fifth surface, and a sixth surface, wherein the first surface and the second surface are parallel to each other, the third surface and the fourth surface are parallel to each other, the fifth surface and the sixth surface are parallel to each other, two opposite sides of the third surface are respectively connected to the first surface and the sixth surface, one side of the sixth surface away from the third surface is connected to the second surface, two opposite sides of the fifth surface are respectively connected to the first surface and the fourth surface; one side of the fourth surface away from the fifth surface is connected to the second surface;

wherein an angle between the first surface and the third surface and an angle between the first surface and the fifth surface, an angle between the second surface and the fourth surface and an angle between the second surface and the sixth surface are obtuse angles; an angle between the third surface and the sixth surface and angle between the fourth surface and the fifth surface are both acute angles, wherein the electronic cigarette further comprises a window section disposed on one or both of the first surface and the second surface, the window portion is hexagon in shape and has a first side, a second side, a third side, a fourth side, a first vertical side, and a second vertical side, wherein the first vertical side and the second vertical side are parallel to each other and are disposed along an axial direction of the electronic cigarette, the first side and the second side are located at the upper ends of the first vertical side and the second vertical side, the third side and the fourth side are located at a lower end of the first vertical side and the second vertical side, two ends of the first side are respectively connected to the first vertical side and the second side, one end of the second side away from the first side is connected to the second vertical side, the opposite ends of the third side are respectively connected to the first vertical side and the fourth side, one end of the fourth side away from the third side is connected with the second vertical side, the first side and the fourth side are parallel to each other, the second side and the third side are parallel to each other; the first side, the second side, the third side, and the fourth side are equal in length, the first vertical side and the second vertical side are equal in length, and a length of the first vertical side or the second vertical side is longer than a length of any one of the first side, the second side, the third side, and the fourth side, wherein the electronic cigarette further comprises a reservoir chamber configured for storing cigarette liquid, a window portion, and a storage portion visible through the window portion, the window portion is exposed through the window section, wherein the electronic cigarette further comprises a cartomizer and a power supply device electrically connected to the cartomizer, the first surface, the second surface, the third surface, the fourth surface, the fifth surface, and the sixth surface respectively comprises a first segment and a second segment, and wherein the window portion comprises a first window notch and a second window notch, the first window notch is defined on the first segment of the first surface or the first segment of the second surface, the second window notch corresponding the first window notch is defined in the second segment of the first surface or the second segment of the second surface, the first window notch and the second window notch are defined in the same surface.

2. The electronic cigarette according to claim 1, wherein the electronic cigarette comprises a smoke outlet located at its top end, wherein two recesses are disposed adjacent to the smoke outlet on the first surface and the second surface, respectively, and each of the two recesses has one soft substrate disposed therein.

3. The electronic cigarette according to claim 1, wherein a connection between two adjacent surfaces of the electronic cigarette is curvilinear in shape.

4. The electronic cigarette according to claim 1, wherein the first surface, the second surface, the third surface, the fourth surface, the fifth surface, and the sixth surface are flat surfaces, the area of the first surface and the area of the second surface are equal, the area of the first surface or the second surface is larger than any one of the third surface, the fourth surface, the fifth surface, and the sixth surface.

5. The electronic cigarette according to claim 1, wherein a distance between the first surface and the second surface is shorter than a distance between the third surface and the fourth surface; the distance between the first surface and the second surface is shorter than a distance between the fifth surface and the sixth the surfaces.

6. The electronic cigarette according to claim 1, wherein the first surface, the second surface, the third surface, the fourth surface, the fifth surface, and the sixth surface are respectively formed by corresponding side surfaces of a mouthpiece cover; the first surface, the second surface, the third surface, the fourth surface, the fifth surface, and the sixth surface of the second segment are respectively formed by corresponding side surfaces of an outer casing of the power supply device.

7. The electronic cigarette according to claim 1, wherein the cartomizer comprises a housing and a mouthpiece cover sleeved on the housing, wherein the housing comprises a reservoir portion and two window portions located on an outside surface of the reservoir portion, the first window notch is defined on the mouthpiece cover, a first portion of the window portion is exposed through the first window notch, a portion of the storage portion is shield by the mouthpiece cover, the power supply device comprises an outer casing, the second window notch is defined on the outer casing, when the cartomizer is connected to the power supply device, a second portion of the window portion is exposed through the second window notch, the second portion of the storage portion is shield by the outer casing.

8. The electronic cigarette according to claim 7, wherein the window portion protrudes from an outer surface of the storage portion, and the window portion cooperates with the second window notch to guide installation of the cartomizer and the power supply device.

9. The electronic cigarette according to claim 7, wherein there are two first window notches, the two first window notches respectively extend through a bottom end of the first segment of the first surface and a bottom end of the first segment of the second surface; there are two second window notches, the second window notches respectively extend through a top end of the first segment of the first surface and a top end of the first segment of the second surface.

10. The electronic cigarette according to claim 9, wherein the first window notch comprises the first side, the second side, a fifth side, a seventh side; the second window notch comprises the third side, the fourth side, a sixth side, and an eighth side, when the cartomizer is connected to the power supply device, the fifth side and the sixth side cooperate to form the first vertical side, the seventh side and the eighth side cooperate to form the second vertical side.

11. The electronic cigarette according to claim 9, wherein there are two window parts having a hexagon structure, the two hexagonal window portions are symmetrically disposed about a centerline of the first surface and a centerline of the second surface, respectively.

12. The electronic cigarette according to claim 2, wherein the cartomizer comprises a housing and a mouthpiece cover sleeved on the housing, the two recesses are defined on the mouthpiece cover.

13. The electronic cigarette according to claim 2, wherein portions of the third surface, the fourth surface, the fifth surface, and the sixth surface that are adjacent to the smoke outlet are contracted toward a central axis of the electronic cigarette.

14. The electronic cigarette according to claim 7, wherein the outer casing defines a cartomizer receiving chamber therein, the cartomizer is detachably inserted into a cartridge receiving cavity.

15. The electronic cigarette according to claim 14, wherein a sidewall of the cartomizer receiving chamber is provided with an engaging projection, a clamping groove is disposed on the sidewall of the housing corresponding to the engaging projection, the outer casing is provided with an indication mark corresponding to the engaging projection.

16. The electronic cigarette according to claim 7, wherein the outer casing is made of metal, the mouthpiece cover is made of plastic.

* * * * *